US010812896B2

(12) United States Patent
Oishi et al.

(10) Patent No.: US 10,812,896 B2
(45) Date of Patent: Oct. 20, 2020

(54) HIGH COMPLIANCE MICROSPEAKERS FOR VIBRATION MITIGATION IN A PERSONAL AUDIO DEVICE

(71) Applicant: Facebook Technologies, LLC, Menlo Park, CA (US)

(72) Inventors: Tetsuro Oishi, Bothell, WA (US); Chuming Zhao, Redmond, WA (US); Gelmont Rios, Redmond, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/555,058

(22) Filed: Aug. 29, 2019

(65) Prior Publication Data

US 2020/0304905 A1 Sep. 24, 2020

Related U.S. Application Data

(60) Provisional application No. 62/821,915, filed on Mar. 21, 2019.

(51) Int. Cl.
*H04R 1/28* (2006.01)
*H04R 1/02* (2006.01)
(Continued)

(52) U.S. Cl.
CPC ..... *H04R 1/2873* (2013.01); *H04R 1/025* (2013.01); *H04R 1/345* (2013.01); *H04R 1/403* (2013.01); *H04R 3/12* (2013.01)

(58) Field of Classification Search
CPC ..... H04R 9/06; H04R 1/2811; H04R 1/021; H04R 1/025; H04R 1/1008; H04R 1/1075; H04R 1/1016; H04R 1/2857; H04R 1/2873; H04R 2400/11; H04R 1/2826; H04R 1/10; H04R 1/2803; H04R 1/345; H04R 3/12;
(Continued)

(56) References Cited

U.S. PATENT DOCUMENTS 5,233,137 A * 8/1993 Geddes ..... F01N 1/065 181/206
10,171,930 B1 * 1/2019 Brown ..... H04S 7/307
(Continued)

FOREIGN PATENT DOCUMENTS

WO WO 01/13677 A1 2/2001
WO WO 2013/030437 A1 3/2013
WO WO 2017/216126 A1 12/2017

OTHER PUBLICATIONS

PCT International Search Report and Written Opinion, PCT Application No. PCT/US2020/019803, dated May 6, 2020, 18 pages.

*Primary Examiner* — Norman Yu
(74) *Attorney, Agent, or Firm* — Fenwick & West LLP

(57) ABSTRACT

An audio system includes a speaker configured to emit sound. The speaker is contained in an enclosure, the enclosure forming a front cavity and a rear cavity that are on opposite sides of the speaker. The enclosure includes: at least one output port configured to output a first portion of the sound from the front cavity and at least one rear port configured to output a second portion of the sound from the rear cavity. The second portion of the sound is substantially out of phase with the first portion. The audio system has an equivalent acoustic volume (Vas) greater than ten times a volume of the front cavity and greater than ten times a volume of the rear cavity.

20 Claims, 11 Drawing Sheets

(51) Int. Cl.
*H04R 1/34* (2006.01)
*H04R 3/12* (2006.01)
*H04R 1/40* (2006.01)

(58) Field of Classification Search
CPC ..... H04R 1/403; H04R 1/347; H04R 1/22; H04R 2499/15; H04R 19/013; H04R 1/2819; H04R 5/033; H04R 19/04; H04R 1/2823; G10K 11/178; G10K 2210/1081
USPC ..... 381/334, 71.6, 71.7, 322, 349, 351, 89; 181/199, 145, 148, 156, 198
See application file for complete search history.

(56) References Cited

U.S. PATENT DOCUMENTS

| | | | | |
|---|---|---|---|---|
| 2014/0072163 | A1 | 3/2014 | Yamada | |
| 2016/0021443 | A1* | 1/2016 | Lee | H04R 1/023 381/334 |
| 2017/0201822 | A1 | 7/2017 | Shetye et al. | |
| 2017/0201823 | A1* | 7/2017 | Shetye | H04R 5/0335 |
| 2019/0052954 | A1 | 2/2019 | Rusconi Clerici Beltrami et al. | |
| 2019/0238971 | A1* | 8/2019 | Wakeland | G02C 11/10 |
| 2019/0306605 | A1 | 10/2019 | Uhring-Cadart et al. | |

* cited by examiner

HIGH COMPLIANCE MICROSPEAKERS FOR VIBRATION MITIGATION IN A PERSONAL AUDIO DEVICE

CROSS-REFERENCE TO RELATED APPLICATIONS

This application claims the benefit of and priority to U.S. Provisional Application No. 62/821,915, filed Mar. 21, 2019, the entire contents of which are hereby incorporated by reference for all purposes as if fully set forth herein.

BACKGROUND

This disclosure relates generally to speakers for headsets, and more specifically to high compliance microspeakers.

High performance speakers are an important component for producing high quality audio for consumer electronics devices. As consumer electronics get smaller, lighter, and more wearable, a lot of design constraints (size, weight, power consumption, etc.) are put into the speakers while still hoping to achieve a good audio quality. Hence, a high-performance speaker with small size, light weight, and less power consumption is desired.

SUMMARY

An audio system includes a speaker configured to emit sound, and at least part of an enclosure containing the speaker. The speaker is a high compliance speaker that includes a transducer with mechanical compliance (Cms) that is high. The transducer may be a diaphragm, also referred to herein as a "membrane," with a high Cms (e.g., greater than 10 mm/N), according to some embodiments. The speaker may be designed such that it mitigates vibration imparted to a surrounding structure (e.g., a personal audio device) the speaker is mounted to. The enclosure containing the speaker forms a front cavity and a rear cavity that are on opposite sides of the speaker. The enclosure includes at least one output port and at least one rear port. The at least one output port is configured to output a first portion of the sound from the front cavity, and the at least one rear port is configured to output a second portion of the sound from the rear cavity. The second portion of the sound is substantially out of phase with the first portion of the sound. An equivalent acoustic volume (Vas) of the audio system is greater than ten times a volume of the front cavity and greater than ten times a volume of the rear cavity. The audio system may achieve a high Vas, while maintaining a relatively small form factor (e.g. having a physical volume less than 5 cubic centimeters) and weight (e.g. less than 4 grams) of the enclosure and the speaker, by combining a high compliance speaker with the enclosure including the at least one output port and the at least one rear port.

In some embodiments, the audio system may be part of a personal audio device (e.g., headset). For example, the audio system may be coupled to a frame of a headset. The audio system has a relatively low resonance frequency, which improves the power efficiency of the audio system and reduces unwanted vibrations in structures coupled to the enclosure and the speaker, such as, for example, the frame of the headset.

The total sound emitted from the audio system may have a dipole configuration, such that the first portion of the sound destructively interferes with the second portion of the sound in the far-field, resulting in low leakage of sound into the far-field, according to some embodiments. As such, the audio system may selectively deliver sound to a user's ear in the near-field.

The high compliance speaker, including the high Cms membrane, may have a rectangular shape. The low resonant frequency and improved power efficiency may be due, in part to the shape of the high compliance speaker. In other embodiments, the high compliance speaker may have a different shape. For example, the audio system may include a high compliance speaker with an elliptical shape.

Figure 1:
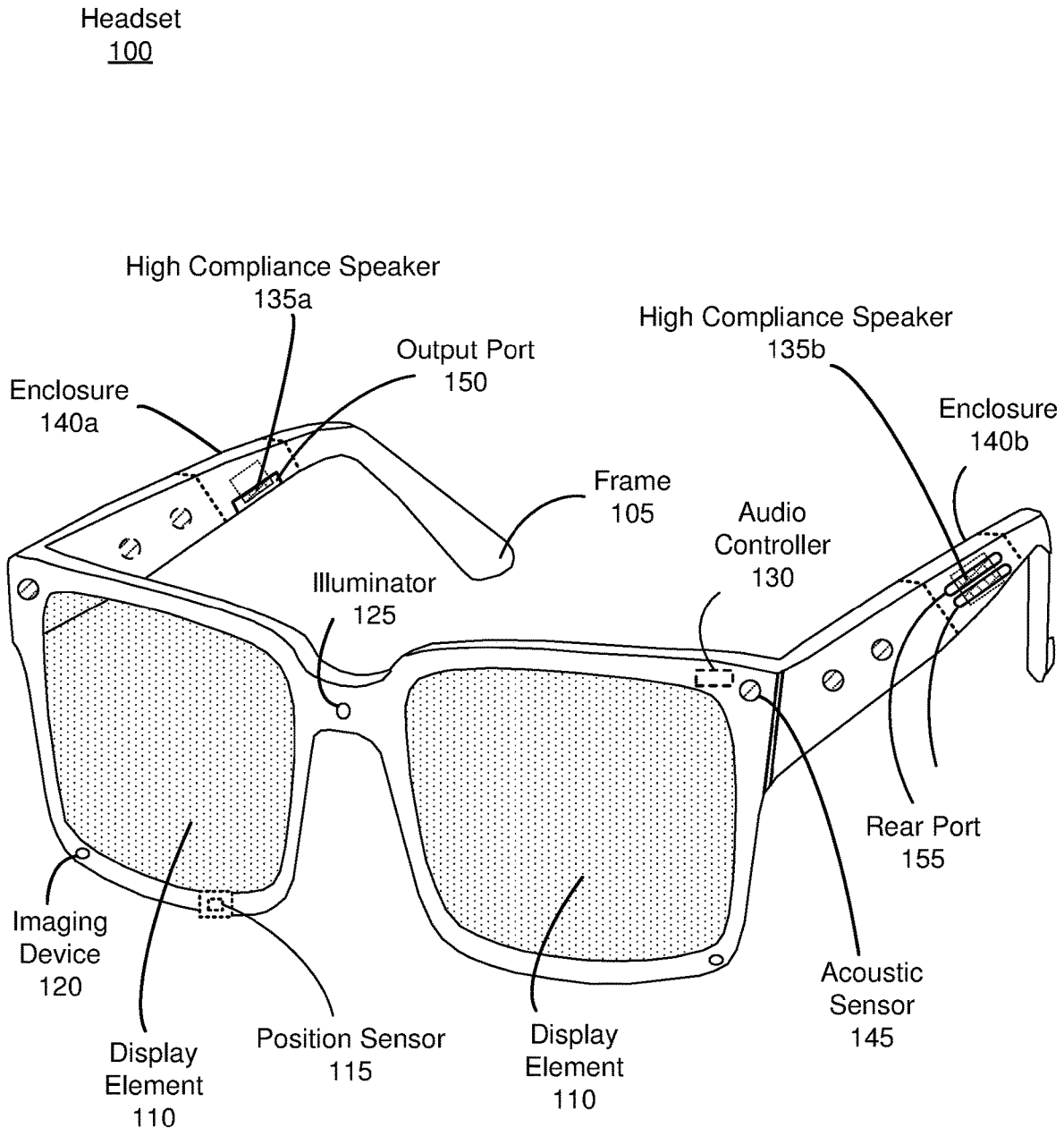
FIG. 1 is a perspective view of a headset implemented as an eyewear device, in accordance with one or more embodiments.

The figures depict embodiments of the present disclosure for purposes of illustration only. One skilled in the art will readily recognize from the following description that alternative embodiments of the structures and methods illustrated herein may be employed without departing from the principles, or benefits touted, of the disclosure described herein.

DETAILED DESCRIPTION

Overview

Rectangular speakers used in smartphones or other consumer electronics typically have transducers with mechanical compliance (Cms) that is low (e.g., 4 mm/N or less) for converting electrical energy into sound, where the Cms of the transducer is the reciprocal of the mechanical stiffness of the transducer. These speakers can have poor performance when integrated into virtual reality (VR), augmented reality (AR), and/or mixed reality headsets. For example, conventional speakers with low Cms transducers tend to be heavy, consume high power, produce unwanted vibrations in the headsets, and are incapable of efficiently generating low frequency audio at high sound volumes.

While speakers with a high Cms transducer are used in some high-performance audio applications, these often have a large form factor and weight. Conventional audio systems using speakers with a small form factor may not provide enough acoustic output for applications such as for use as on-board speakers for headsets, particularly at low frequencies. Additionally, some applications use features unavailable in such conventional audio systems, such as far-field acoustic cancellations, to provide privacy for users. As a result, small form factor speakers with high audio performance, including at low frequencies, are desired.

An audio system is provided that includes one or more audio assemblies and an audio controller (e.g., controls audio content output by the audio system). The one or more audio assemblies include a speaker. According to some embodiments, the speaker may be a high compliance speaker having a transducer in the form of a high Cms membrane. The audio assembly includes at least some of a speaker enclosure, also referred to herein as an "enclosure." In some embodiments, the remaining portion of the enclosure is part of a device (e.g., a personal audio device) the audio assembly couples to. A personal audio device is a device worn and/or carried by a user that includes the audio system, and is configured to present audio to a user via the audio system. A personal audio device may be, e.g., a headset, a cellphone, a tablet, some other device configured to present audio to a user via the audio system, or some combination thereof. In other embodiments the audio assembly include all of the enclosure, and the whole enclosure couples to a device (e.g., a headset). The enclosure contains a high compliance speaker that achieves a higher equivalent acoustic volume (Vas) than comparably sized audio assemblies including a speaker with a lower Cms transducer. In some embodiments, an audio assembly has a small form factor (e.g. having a physical volume less than 5 cubic centimeters) and low weight of the speaker (e.g. less than 2 grams) which is beneficial for applications, such as an audio system for use in a headset. In this example, the high compliance speaker may have a transducer with a Cms greater than 10 N/mm and a Vas greater than 15 cc. The audio assembly may have a Vas greater than ten times the physical volume of an acoustic cavity of the enclosure, according to some embodiments. For example, if an enclosure has a front acoustic cavity with a volume of 1 cubic centimeter (cc), a Vas of the audio system is 10 cc or greater.

Using an audio assembly with high Vas, small form factor, and a low weight speaker for use in a headset is advantageous. In order to provide a comfortable user experience, the audio assembly may be integrated or coupled into a portion of a frame of a headset, according to some embodiments. Specifically, the enclosure may be integrated into a leg portion of the frame. In some embodiments, the enclosure is integrated into a temple portion of a leg portion of the frame, the temple portion corresponding to a temple region on a user's head. The audio assembly has a small form factor and weight, which may result in a more comfortable experience for the user of the headset with the audio assembly integrated into the temple portion of the frame, without sacrificing audio quality and/or audio volume.

Embodiments of the present disclosure may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. In some embodiments, the headset including the audio system is configured for use in an artificial reality system. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a headset connected to a host computer system, a standalone headset, a mobile device or computing system, or any other hardware platform capable of providing artificial reality content to one or more viewers.

FIG. 1 is a perspective view of a headset 100 implemented as an eyewear device, in accordance with one or more embodiments. In some embodiments, the eyewear device is a near eye display (NED). In general, the headset 100 may be worn on the face of a user such that content (e.g., media content) is presented using a display assembly and/or an audio system. However, the headset 100 may also be used such that media content is presented to a user in a different manner. Examples of media content presented by the headset 100 include one or more images, video, audio, or some combination thereof. The headset 100 includes a frame 105, and may include, among other components, a display assembly including one or more display elements 110, a depth camera assembly (DCA), an audio system, and a position sensor 115. While FIG. 1 illustrates the components of the headset 100 in example locations on the headset 100, the components may be located elsewhere on the headset 100, on a peripheral device paired with the headset 100, or some combination thereof. Similarly, there may be more or fewer components on the headset 100 than what is shown in FIG. 1.

The frame 105 holds the other components of the headset 100. The frame 105 includes a front part that holds the one or more display elements 110 and end pieces (e.g., temples) to attach to a head of the user. The front part of the frame 105 bridges the top of a nose of the user. The length of the end pieces may be adjustable (e.g., adjustable temple length) to fit different users. The end pieces may also include a portion that curls behind the ear of the user (e.g., temple tip, ear piece). The end piece may also be referred to herein as a "leg portion of the frame."

The one or more display elements 110 provide light to a user wearing the headset 100. As illustrated the headset includes a display element 110 for each eye of a user. In some embodiments, a display element 110 generates image light that is provided to an eyebox of the headset 100. The eyebox is a location in space that an eye of user occupies while wearing the headset 100. For example, a display element 110 may be a waveguide display. A waveguide display includes a light source (e.g., a two-dimensional source, one or more line sources, one or more point sources, etc.) and one or more waveguides. Light from the light source is in-coupled into the one or more waveguides which outputs the light in a manner such that there is pupil replication in an eyebox of the headset 100. In-coupling and/or outcoupling of light from the one or more waveguides may be done using one or more diffraction gratings. In some embodiments, the waveguide display includes a scanning element (e.g., waveguide, mirror, etc.) that scans light from the light source as it is in-coupled into the one or more waveguides. Note that in some embodiments, one or both of the display elements 110 are opaque and do not transmit light from a local area around the headset 100. The local area is the area surrounding the headset 100. For example, the local area may be a room that a user wearing the headset 100 is inside, or the user wearing the headset 100 may be outside and the local area is an outside area. In this context, the headset 100 generates VR content. Alternatively, in some embodiments, one or both of the display elements 110 are at least partially transparent, such that light from the local area may be combined with light from the one or more display elements to produce AR and/or MR content.

In some embodiments, a display element 110 does not generate image light, and instead is a lens that transmits light from the local area to the eyebox. For example, one or both of the display elements 110 may be a lens without correction (non-prescription) or a prescription lens (e.g., single vision, bifocal and trifocal, or progressive) to help correct for defects in a user's eyesight. In some embodiments, the display element 110 may be polarized and/or tinted to protect the user's eyes from the sun.

Note that in some embodiments, the display element 110 may include an additional optics block (not shown). The optics block may include one or more optical elements (e.g., lens, Fresnel lens, etc.) that direct light from the display element 110 to the eyebox. The optics block may, e.g., correct for aberrations in some or all of the image content, magnify some or all of the image, or some combination thereof.

The DCA determines depth information for a portion of a local area surrounding the headset 100. The DCA includes one or more imaging devices 120 and a DCA controller (not shown in FIG. 1), and may also include an illuminator 125. In some embodiments, the illuminator 125 illuminates a portion of the local area with light. The light may be, e.g., structured light (e.g., dot pattern, bars, etc.) in the infrared (IR), IR flash for time-of-flight, etc. In some embodiments, the one or more imaging devices 120 capture images of the portion of the local area that include the light from the illuminator 125. As illustrated, FIG. 1 shows a single illuminator 125 and two imaging devices 120. In alternate embodiments, there is no illuminator 125 and at least two imaging devices 120.

The DCA controller computes depth information for the portion of the local area using the captured images and one or more depth determination techniques. The depth determination technique may be, e.g., direct time-of-flight (ToF) depth sensing, indirect ToF depth sensing, structured light, passive stereo analysis, active stereo analysis (uses texture added to the scene by light from the illuminator 125), some other technique to determine depth of a scene, or some combination thereof.

The audio system provides audio content. The audio system includes a sensor array, a speaker array, and an audio controller 130. However, in other embodiments, the audio system may include different and/or additional components. Similarly, in some cases, functionality described with reference to the components of the audio system can be distributed among the components in a different manner than is described here. For example, some or all of the functions of the controller may be performed by a remote server.

The speaker array presents sound to user. The speaker array includes one or more audio assemblies. As shown in FIG. 1, the audio system of the headset 100 includes two audio assemblies, with one audio assembly corresponding to a left ear of the user and another audio assembly corresponding to a right ear of the user. Each audio assembly includes a high compliance speaker and at least a portion of an enclosure. For example, as shown in FIG. 1, the audio system of the headset 100 includes an audio assembly coupled to a right side of the frame 105, including the high compliance speaker 135*a* and a portion of the enclosure 140*a*, corresponding to the right ear of the user and another audio assembly coupled to a left side of the frame 105, including the high compliance speaker 135*b* and a portion of the enclosure 140*b*, corresponding to the left ear of the user. Each of the high compliance speakers 135*a* and 135*b* (collectively, the high compliance speakers 135) is contained in a respective one of the enclosures 140*a* and 140*b* (collectively, the enclosures 140). In some embodiments, the audio system also includes an array of tissue transducers (e.g., a bone conduction transducer or a cartilage conduction transducer). Although the high compliance speakers 135 are shown enclosed in the frame 105, the high compliance speakers 135 may be exterior to the frame 105. In some embodiments, instead of individual speakers for each ear, the headset 100 includes a speaker array comprising multiple speakers integrated into the frame 105 to improve directionality of presented audio content. The tissue transducer couples to the head of the user and directly vibrates tissue (e.g., bone or cartilage) of the user to generate sound. The number and/or locations of high compliance speakers 135 may be different from what is shown in FIG. 1.

In FIG. 1, each of the enclosures 140 is shown integrated into a leg portion of the frame 105, but an enclosure may be coupled to the frame in a different configuration, according to some embodiments. Each of the enclosures 140 includes an output port 150 coupled to a front cavity of the respective enclosure and two rear ports 155 coupled to a rear cavity of the enclosure. In other embodiments, an enclosure may include more than one output port and one or more rear ports. In some embodiments, at least one of the rear ports is a resistive port configured to dampen the second portion of sound emitted from the rear cavity of the enclosure 140. The resistive port may smoothen the frequency response of the respective enclosure, in addition to providing dust protection for the respective high compliance speaker. The resistive port may have the form of a mesh film or fabric covering an opening defined in the respective enclosure, according to some embodiments. In other embodiments, at least one of the rear ports is an open port that does not dampen the second portion of the sound. In other embodiments, one or both of the enclosures 140 includes a plurality of rear ports that are a combination of resistive ports and open ports. The high compliance speaker emits sound, in response to an electronic audio signal received from the controller 120, according to some embodiments. The controller 120 may provide and transmit instructions for the audio system to present audio content to the user. The output port 150 is configured to output a first portion of the sound from the front cavity of the enclosure 140, and the two rear ports 155 are configured to output a second portion of the sound from the rear cavity of the enclosure 140.

In some embodiments, each of the output ports 150 faces an interior of the frame 105. The interior is a direction facing a head of the user wearing the headset 100. In this case, the two rear ports 155 faces an exterior of the frame 105. The exterior is the direction facing away from the head of the user wearing the headset 100.

The audio assembly, including the high compliance speakers 135, may achieve a high Vas, relative to the actual size or weight of the audio assembly, without excessive electrical power consumption, resulting in high efficiency audio performance. This is advantageous for audio systems used in headsets, where the audio assembly may need to fit in a relatively small space. Thus, the audio assemblies, as shown for example in FIG. 1, may satisfy the design requirements for a variety of headset configurations without sacrificing audio performance and/or audio volume. In comparison to other audio systems of comparable size and weight, the audio system may generate sounds at a higher sound volume with the same or less electrical power input, according to some embodiments. For instance, using the same electrical power input, the audio system may generate sounds at a higher sound volume than a comparably sized audio system that does not include an embodiment of the enclosure 140 and an embodiment of the high compliance speaker 135, according to some embodiments.

The audio system may also be included in or integrated with devices other than a headset, according to some embodiments. For example, the audio system may be integrated with a mobile device, or any other application requiring a small, light-weight speaker with relatively efficient audio performance.

The sensor array detects sounds within the local area of the headset 100. The sensor array includes a plurality of acoustic sensors 145. An acoustic sensor 145 captures sounds emitted from one or more sound sources in the local area (e.g., a room). Each acoustic sensor is configured to detect sound and convert the detected sound into an electronic format (analog or digital). The acoustic sensors 145 may be acoustic wave sensors, microphones, sound transducers, or similar sensors that are suitable for detecting sounds.

In some embodiments, one or more acoustic sensors 145 may be placed in an ear canal of each ear (e.g., acting as binaural microphones). In some embodiments, the acoustic sensors 145 may be placed on an exterior surface of the headset 100, placed on an interior surface of the headset 100, separate from the headset 100 (e.g., part of some other device), or some combination thereof. The number and/or locations of acoustic sensors 145 may be different from what is shown in FIG. 1. For example, the number of acoustic detection locations may be increased to increase the amount of audio information collected and the sensitivity and/or accuracy of the information. The acoustic detection locations may be oriented such that the microphone is able to detect sounds in a wide range of directions surrounding the user wearing the headset 100.

The audio controller 130 processes information from the sensor array that describes sounds detected by the sensor array. The audio controller 130 may comprise a processor and a computer-readable storage medium. The audio controller 130 may be configured to generate direction of arrival (DOA) estimates, generate acoustic transfer functions (e.g., array transfer functions and/or head-related transfer functions), track the location of sound sources, form beams in the direction of sound sources, classify sound sources, generate sound filters for the high compliance speakers 135, or some combination thereof.

The position sensor 115 generates one or more measurement signals in response to motion of the headset 100. The position sensor 115 may be located on a portion of the frame 105 of the headset 100. The position sensor 115 may include an inertial measurement unit (IMU). Examples of position sensor 115 include: one or more accelerometers, one or more gyroscopes, one or more magnetometers, another suitable type of sensor that detects motion, a type of sensor used for error correction of the IMU, or some combination thereof. The position sensor 115 may be located external to the IMU, internal to the IMU, or some combination thereof.

In some embodiments, the headset 100 may provide for simultaneous localization and mapping (SLAM) for a position of the headset 100 and updating of a model of the local area. For example, the headset 100 may include a passive camera assembly (PCA) that generates color image data. The PCA may include one or more RGB cameras that capture images of some or all of the local area. In some embodiments, some or all of the imaging devices 120 of the DCA may also function as the PCA. The images captured by the PCA and the depth information determined by the DCA may be used to determine parameters of the local area, generate a model of the local area, update a model of the local area, or some combination thereof. Furthermore, the position sensor 115 tracks the position (e.g., location and pose) of the headset 100 within the room. Additional details regarding the components of the headset 100 are discussed below in connection with FIG. 8.

Some embodiments of the headset 100 and audio system have different components than those described here. For example, the enclosure 140 may include a different configuration of ports, for example, with a different number, shape, type, and/or size of ports. The example of the audio system shown in FIG. 1 includes two enclosures 140, each enclosure containing a high compliance speaker, corresponding to a left and right ear for presenting stereo sound. In some embodiments the audio system comprises speaker array including a plurality of enclosures 140 (e.g. more than two) coupled to the frame 105 of the headset 100. In this case, each enclosure contains one or more high compliance speakers. Similarly, in some cases, functions can be distributed among the components in a different manner than is described here. Additionally, the dimensions or shapes of the components may be different.

High Compliance Speaker

Figure 2A:
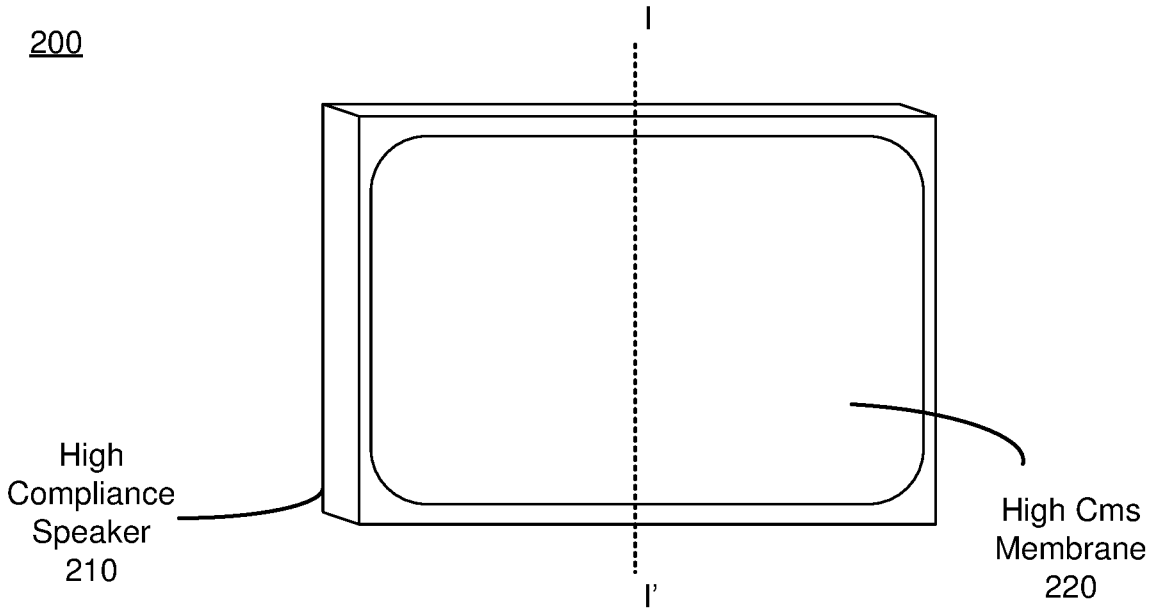
FIG. 2A illustrates a front view of a high compliance speaker including a membrane with a mechanical compliance (Cms) that is high, in accordance with one or more embodiments.
Figure 2B:
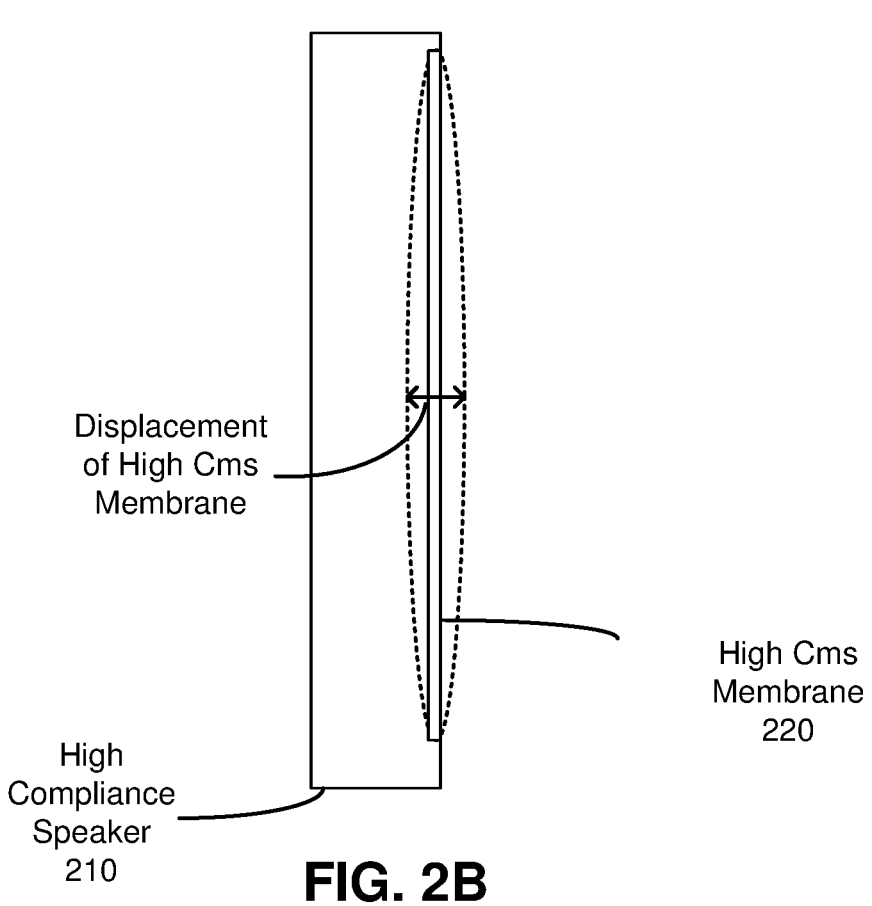
FIG. 2B shows a cross-section along a line I to I' of the high compliance speaker shown in FIG. 2A, in accordance with one or more embodiments.

FIG. 2A illustrates a front view of a high compliance speaker 210 including a membrane with a Cms that is high, in accordance with one or more embodiments. The high compliance speaker 210 is an embodiment of the high compliance speaker 135. The high compliance speaker 210 has a rectangular shape, corresponding to a rectangular prism, according to some embodiments. In the example shown in FIG. 2A, a surface of the high Cms membrane 220 also has an approximately rectangular shape. In further embodiments, the high Cms membrane 220 has an approximate 2D shape corresponding to a rectangle with rounded corners, as shown in FIG. 2A. In other embodiments, the high compliance speaker 210 and the high Cms membrane 220 may have other shapes than what is shown in FIGS. 2A and 2B.

The rectangular shape of the high compliance speaker 210 may satisfy various design requirements. For example, the high compliance speaker 210 may be used in a temple region of a leg of a headset (e.g., eyeglass form factor), as shown in FIG. 1. As such, a rectangular shape may be desired for the high compliance speaker 210, to conform to the shape of the temple region.

In other embodiments, the high Cms membrane 220 has an elliptical shape. In further embodiments, the body of the high compliance speaker 210 also has a shape corresponding to an ellipse, such as a shape approximating an elliptical prism. Using an elliptical shape of the high Cms membrane 220 may make it easier to suppress undesired resonant modes of the high compliance speaker 210, while still maintaining a shape that is effective for designs that require non-circular speakers, according to some embodiments. In other embodiments, the high compliance speaker 210 and the high Cms membrane 220 has other shapes, to match design requirements for various applications of the audio system. In other embodiments, the high compliance speaker 210 may have a different overall shape from the high Cms membrane 220. For example, the high compliance speaker may have a rectangular shape 210, while the high Cms membrane 220 has an elliptical shape. The high compliance speaker 210 and the high Cms membrane 220 each may have shapes other than a rectangular shape or an elliptical shape, according to some embodiments.

Additionally, the high compliance speaker 210 may has a small size suitable for various design requirements, such as for integration with a headset. In some embodiments, the high compliance speaker 210 is a speaker with a total area of the high Cms membrane 220 being less than 200 square millimeters. The high Cms membrane 220 may have a different size, according to some embodiments.

FIG. 2B shows a cross-section along a line I to I' of the high compliance speaker 210 shown in FIG. 2A, in accordance with one or more embodiments. The high compliance speaker 210 includes components not shown in FIG. 2B, such as electrical circuit elements, according to some embodiments. In response to receiving an electrical audio signal, the high compliance speaker 210 actuates the high Cms membrane 220, generating an acoustic wave (i.e. the emitted sound) corresponding to the received electrical audio signal. The actuated Cms membrane 220 may be displaced, as depicted in FIG. 2B, according to some embodiments. A high Cms membrane (e.g., a membrane having a Cms greater than 10 mm/N) has a greater displacement of the membrane than a low Cms membrane, in response to an electrical audio signal. In some embodiments, the high Cms membrane 220 has a lower stiffness than a membrane with a low Cms, such that the amount of energy necessary to displace the high Cms membrane 220 is lower than that of a low Cms membrane. Also, the high CMS membrane 220 may generally have larger displacement amplitudes of the high Cms membrane 220 than a speaker of the same size with a low Cms membrane. The audio system including the high compliance speaker 210, coupled with the enclosure 140, according to some embodiments, may have a high Vas, relative to the size of the enclosure 140.

The high compliance speaker 210, due in part to the low stiffness of the high Cms membrane 220, may have a low resonant frequency, relative to speakers of the same size that have a low Cms membrane, according to some embodiments. Lower resonant frequencies enable the audio system to have a larger bandwidth and improved performance at low frequencies, than audio systems with higher resonant frequencies. In some embodiments, the high compliance speaker 210 has a resonant frequency of the fundamental node that is less than 200 Hz. In other embodiments, the high compliance speaker 210 has a resonant frequency of the fundamental node that is in the range of 100-200 Hz.

Additionally, the high compliance speaker 210 has improved power efficiency over other speakers when enclosed in an embodiment of the enclosure 140. Compared to comparably sized speakers that either use a low Cms membrane and/or have an enclosure with a rear cavity that is sealed (e.g. omitting a rear port in the enclosure), the proportion of electrical energy that is converted into sound energy is higher in the high compliance speaker 210. This is due in part to the reduction in unwanted vibrations in the audio system and in devices and/or structures coupled to the audio system. For example, the acceleration of unwanted vibrations caused by the audio system may be 10 times lower than acceleration caused by speaker systems of the same size, using a low compliance speaker or using an enclosure without the features of the enclosure 140. The unwanted vibrations may occur in the speaker itself, the enclosure, structures coupled to the audio system (e.g. a frame of a headset), and some combination thereof.

To produce sounds, the high-compliance speaker 210 can be actuated by relatively small electromagnetic force which further minimizes the structural vibration of structures coupled to the audio system (e.g., a frame of artificial reality glasses and headsets). According to some embodiments, a force ratio of the high compliance speaker 210 may be less than 0.1. The force ratio is equal to the amount of applied force required to displace a membrane of a speaker by 0.3 mm divided by a reference force value, where the reference force is 0.33 N. In some embodiments, an acceleration ratio of the high compliance speaker may be less than 0.1. The acceleration ratio is equal to the amount of acceleration a membrane of a speaker undergoes in order to be displaced by 0.3 mm divided by a reference acceleration, where the reference acceleration is 0.000183 $m/s^2$.

Additionally, the power consumption for the high compliance speaker 210 is a fraction of typical rectangular speakers, such as those found in smartphones. For applications such as speakers for headsets and/or glasses, vibration reduction is strongly desired to eliminate the unwanted tactility sensed by users.

The high compliance speaker 210 has a reduced weight which reduces the overall weight of headsets that include the audio system. In some embodiments, the weight of the high compliance speaker is 2 grams or less. In comparison to typical rectangular speakers found in smartphones, the weight of two of the high compliance speakers 210 (corresponding to a left and right speaker for audio sound) may be about 17% lighter. In some embodiments, the high compliance speaker 210 has a height dimension in the range of 10-11 mm, a length dimension in the range of 18-20 mm, and a depth dimension in a range of 2-4 mm. In some embodiments, the weight of two of the high compliance speakers 210 totals less than 4 grams (each weighing less than 2 grams).

Speaker Enclosure

Figure 3A:
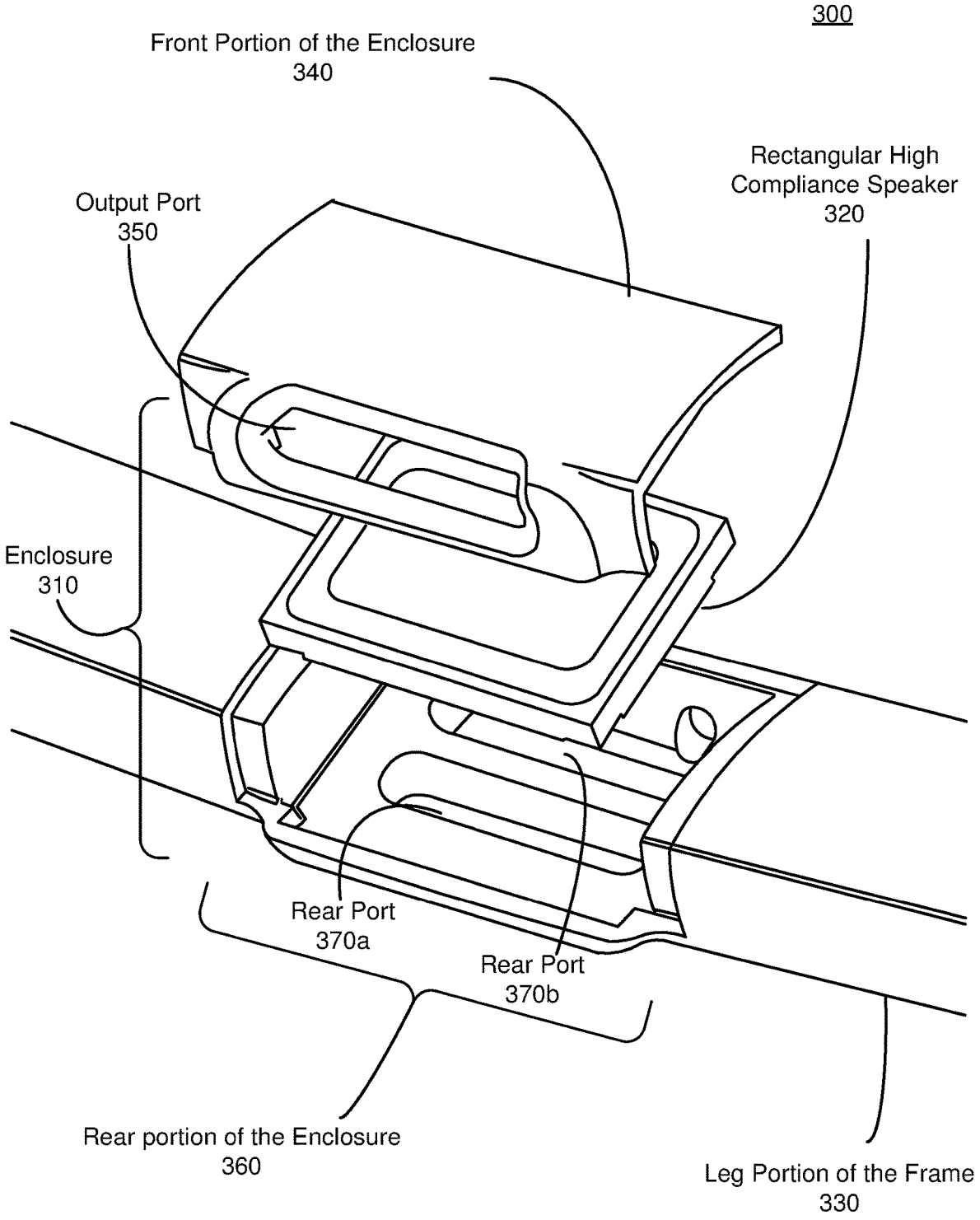
FIG. 3A illustrates an exploded view of an enclosure containing a rectangular high compliance speaker, in accordance with one or more embodiments.

FIG. 3A illustrates an exploded view 300 of an enclosure 310 containing a rectangular high compliance speaker 320, in accordance with one or more embodiments. The rectangular high compliance speaker 320 is an embodiment of the high compliance speaker 210. The enclosure 140 is an embodiment of the enclosure 310. The enclosure 310 is integrated into a leg portion of a frame 330 of a headset. The leg portion of the frame 330 may be part of an embodiment of the headset 100.

The enclosure 310 forms a front cavity and a rear cavity that are on opposite sides of the rectangular high compliance speaker 320. A front portion of the enclosure 340 includes an output port 350 configured to output a first portion of sound emitted from the rectangular high compliance speaker 320 from the front cavity. In some embodiments, the front portion of the enclosure 340 includes a plurality of output ports. A rear portion of the enclosure 360 includes one or more rear ports configured to output a second portion of emitted sound from the rear cavity. As illustrated, the rear portion of the enclosure 360 includes two rear ports 370*a* and 370*b* (collectively, the rear ports 370).

A rear portion of the enclosure 360, including the two rear ports 370, is a part of the frame of the headset, such that the leg portion of the frame 330 and the rear portion of the enclosure 360 form one continuous body. In other embodiments, the front portion of the enclosure 340 is a part of the frame of the headset. In the example shown in FIG. 3A, the front portion of the enclosure 340, including the output port 350, is a separate part that can be separated from and reattached to the rear portion of the enclosure 360. In alternate embodiments, the rear portion of the enclosure 360 and the front portion of the enclosure 340 are distinct components that can be separated from each other and reattached. Additionally, in FIGS. 3A-3C, the enclosure 310 is shown with the one output port 350 and the two rear ports 370, but the number and configuration of output ports and rear ports may be different, according to some embodiments.

The rectangular high compliance speaker 320 may be contained by the enclosure 310 integrated into the leg portion of the frame 330, in a way that is optimal for the space and size constraints of the frame. The shape of a high compliance speaker in the audio system may be configured to optimize the audio performance of the audio system, for the size and space constraints of the frame of the headset.

In some embodiments, the enclosure 310 includes a same material that is used to form the leg portion of the frame 330. In other embodiments, the enclosure 310 includes a different material than is used to form the leg portion of the frame 330.

The rectangular high compliance speaker 320 is contained by the enclosure 310 and positioned in a space between the rear portion of the enclosure 360 and the front portion of the enclosure 340. The enclosure 310 forms the rear cavity and the front cavity, with the rectangular high compliance speaker 320 separating the rear cavity from the front cavity. The output port 350 is coupled to the front cavity, and the two rear ports 370 are coupled to the rear cavity. The enclosure 310 may include additional components than shown in FIGS. 3A-3C, such as ports for electrical components and wiring, for example. In other embodiments, the audio system, including the enclosure 310, and the frame of the headset have different configurations.

Figure 3B:
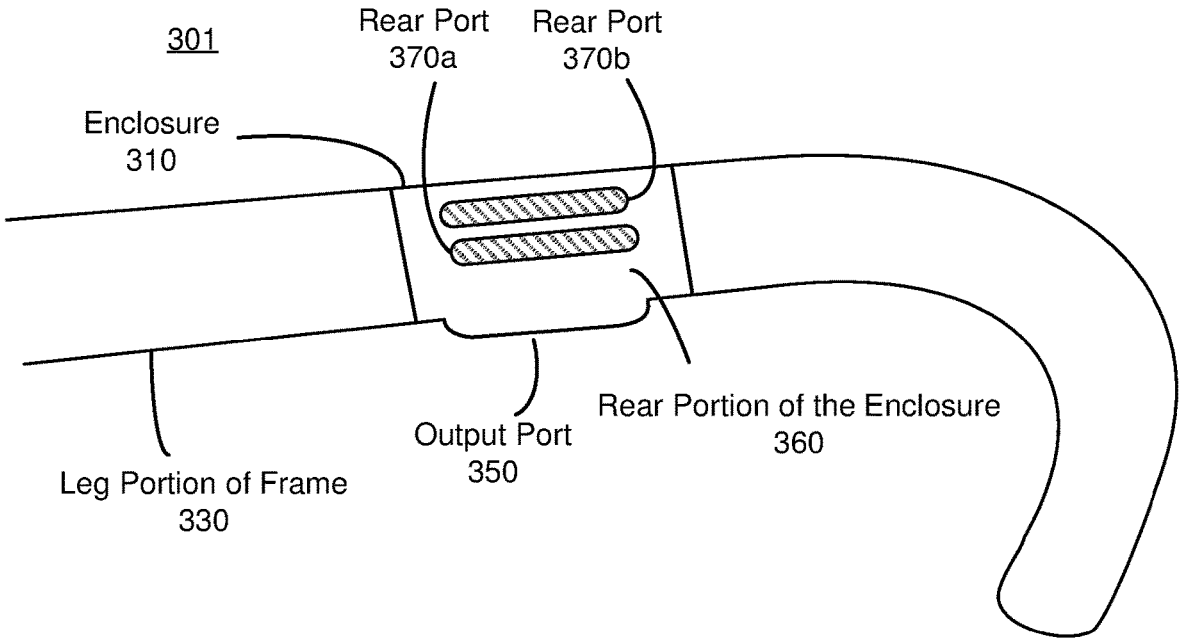
FIG. 3B shows a rear view of the enclosure shown in FIG. 3A, integrated into a leg portion of a frame of a headset, in accordance with one or more embodiments.

FIG. 3B shows a rear view 301 of the enclosure 310 shown in FIG. 3A, integrated into the leg portion of a frame 330 of a headset, in accordance with one or more embodiments. The rear portion of the enclosure 360, including the two rear ports 370, may correspond to a direction away from the ear of the user. In other embodiments, a rear port 370 may be positioned in different locations or have a different shape than shown in FIG. 3A.

In some embodiments, the two rear ports 370 are resistive ports configured to dampen the second portion of sound emitted from the rear cavity of the enclosure 310. For example, using resistive ports may provide a directionality to the total sound emitted from audio system, such that sound emitted from the audio system is louder when heard from a specific direction than when heard from another direction. In some embodiments, the sound emitted from the audio system is louder in a direction corresponding to an ear of the user. In other embodiments, the two rear ports 370 are open ports that do not dampen the first portion of the sound. In other embodiments, the enclosure 310 may include a plurality of rear ports 370 that are a combination of open ports and resistive ports.

Figure 3C:
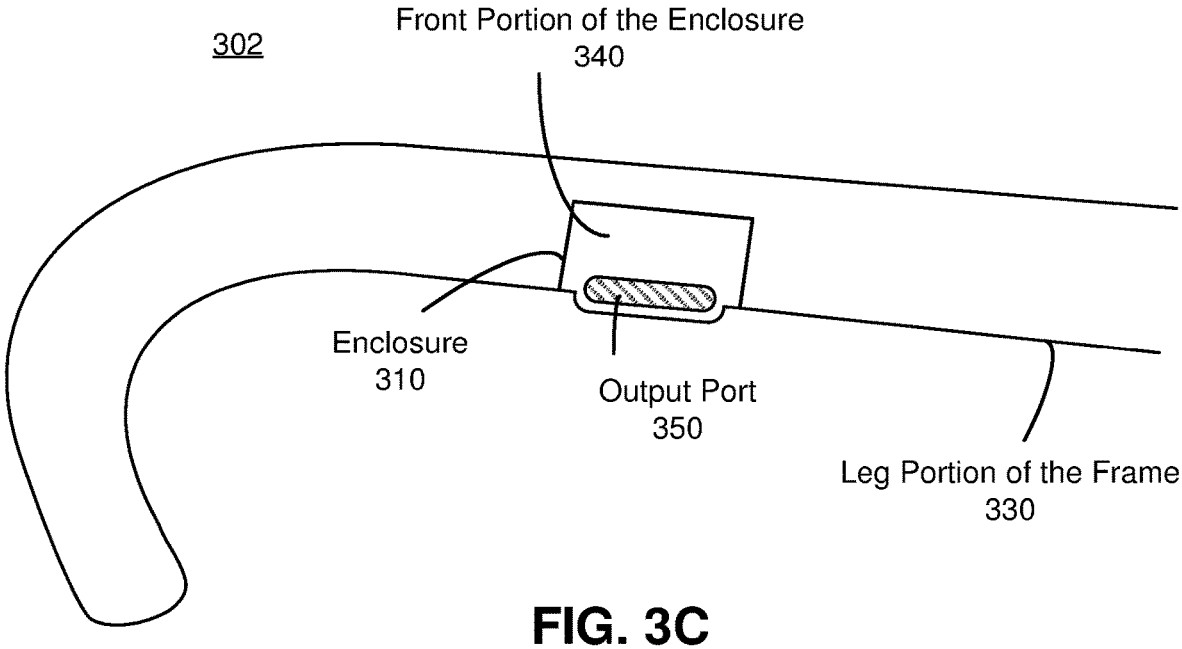
FIG. 3C shows a front view of the enclosure shown in FIGS. 3A and 3B, integrated into the leg portion of the frame of the headset, in accordance with one or more embodiments.

FIG. 3C shows a front view 302 of the enclosure 310 shown in FIGS. 3A and 3B, integrated into the leg portion of the frame 330 of the headset, in accordance with one or more embodiments. The front view 302 shows the leg portion of the frame 330 and the enclosure 310 from a perspective opposite to the one shown in the rear view 301 of FIG. 3B. The output port 350 is positioned in a lower portion of the front portion of the enclosure 340, with the position of the output port 350 corresponding to an ear of a user, according to some embodiments. Although the output port 350 in FIGS. 3A-3B is positioned on the front portion of the enclosure 340, other embodiments include other configurations where the output port 350 is positioned in a different portion of the enclosure 310 than what is shown in FIGS. 3A-3C. The output port 350 may be configured to direct the first portion of the sound towards an ear of a user wearing the headset, in some embodiments.

The emitted sound, including the first portion of the sound and the second portion of the sound, may include audio content intended only for the user wearing the headset. In some embodiments, the emitted sound is intended for the user to hear, but is not intended to be heard by individuals other than the user, for example, in cases where privacy of the user is a concern.

In some embodiments, the two rear ports 370 enable sound to be emitted in a dipole configuration, including the first portion of the sound and the second portion of the sound, from the enclosure. The two rear ports 370 allow the second portion of the sound to be emitted outwards from the rear cavity of the enclosure 310 in a rear direction. At least one rear port is configured to emit the second portion of the sound from the rear cavity. The second portion of the sound is substantially out of phase with the first portion emitted outwards in a front direction from the output port 350.

In some embodiments, the second portion of the sound has a 180° phase offset from the first portion of the sound, resulting overall in dipole sound emissions. As such, sounds emitted from the audio system experience dipole acoustic cancellation in the far-field where the emitted first portion of the sound from the front cavity interfere with and cancel out the emitted second portion of the sound from the rear cavity in the far-field, and leakage of the emitted sound into the far-field is low. This is desirable for applications where privacy of a user is a concern, and sound emitted to people other than the user is not desired. For example, since the ear of the user wearing the headset is in the near-field of the sound emitted from the audio system, the user may be able to exclusively hear the emitted sound.

The enclosure 310 has a small form factor (e.g. a total volume of the enclosure may be less than 5 cc) which can be more easily integrated into, e.g., artificial reality headsets, than enclosures for audio systems with a larger size. The enclosure 310 is integrated into a temple portion of the leg portion of the frame 330, according to some embodiments. The temple portion corresponds to a temple region on a head of a user, such that when the user is wearing the headset, the temple portion of the headset is located near the temple region of the user. As shown in FIGS. 3A-3C, the output port 350 directs the first portion of the sound downwards from the temple region and towards the ear of the user, according to some embodiments.

Front and Rear Cavity

Figure 4:
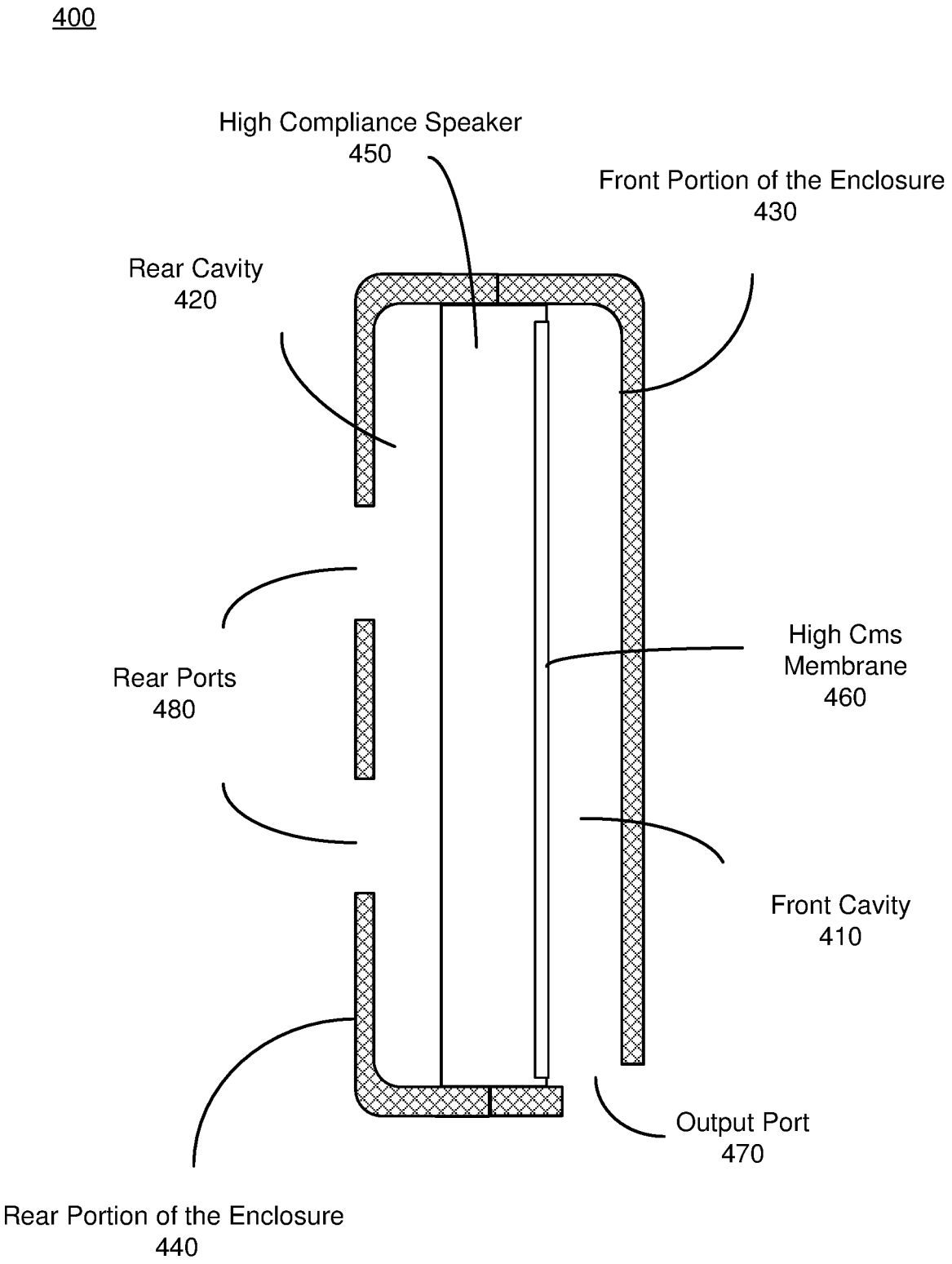
FIG. 4 illustrates a cross-section of an enclosure containing a high compliance speaker, in accordance with one or more embodiments.

FIG. 4 illustrates a cross-section 400 of an enclosure containing a high compliance speaker 450, in accordance with one or more embodiments. The enclosure, as shown in FIG. 4, is an embodiment of the enclosure 310. The cross-section 400 may be along a center line of an embodiment of the enclosure 310, according to some embodiments. The cross-section 400 shows a front cavity 410 and a rear cavity 420 formed by a front portion of the enclosure 430 and a rear portion of the enclosure 440. The enclosure contains a high compliance speaker 450 which separates the front cavity 410 from the rear cavity 420. The high compliance speaker 450 includes a high Cms membrane 460 which faces the front cavity 410. The high compliance speaker 450 is an embodiment of the high compliance speaker 210.

The front portion of the enclosure 430 includes an output port 470 coupled to the front cavity 410. The output port 470 outputs a first portion of the sound emitted by the high compliance speaker 450 from the front cavity 410. The rear portion of the enclosure 440 includes the rear ports 480 coupled to the rear cavity 420. The rear ports 480 output a second portion of the sound emitted by the high compliance speaker 450 from the rear cavity 420.

To meet design requirements for integrating the audio system into a device such as a headset, the front cavity and rear cavity may have relatively small volumes (e.g., 5 cubic centimeters or less). In some embodiments, the rear cavity and front cavity each have a volume of 1 cc or less. For example, the rear cavity and/or the front cavity may each have a volume that ranges between 0.3-0.4 cc. In some embodiments, the volume of both the front cavity 410 and the rear cavity 420 is substantially the same size. In other embodiments, a volume of the front cavity 410 is different than a volume of the rear cavity 420. In other embodiments, the front cavity 410 may have a significantly different shape from a shape of the rear cavity 420.

The combination of an embodiment of the high compliance speaker 450 and an embodiment of the enclosure 310, including the one or more output ports coupled to a front cavity and one or more rear ports coupled to a rear cavity, results in a Vas of the audio system that is greater than ten times the volume of the front cavity and greater than ten times the volume of the rear cavity. For example, the Vas of the audio system may be at least 100 times the volume of the front cavity and at least 100 times the volume of the rear cavity. In this case, an example of the audio system, as shown in FIG. 4, having a front cavity 410 with a physical volume of 0.3 cc and a rear cavity 420 with a physical volume of 0.3 cc may have a Vas of 30 cc or greater. The high Vas of the audio system is due in part to the high compliance of the combined speaker with the high Cms membrane and the enclosure with the at least one rear port. In some examples, the high compliance speaker may have an air volume displacement greater than 60 cubic millimeters. In comparison, an audio system using a high compliance speaker that is contained in an enclosure that only has an output port in a front direction, without a rear cavity and/or a rear port coupled to the rear cavity, will have a lower compliance than the audio system including the at least one rear port disclosed herein, of comparable size.

Offset Configuration

Figure 5A:
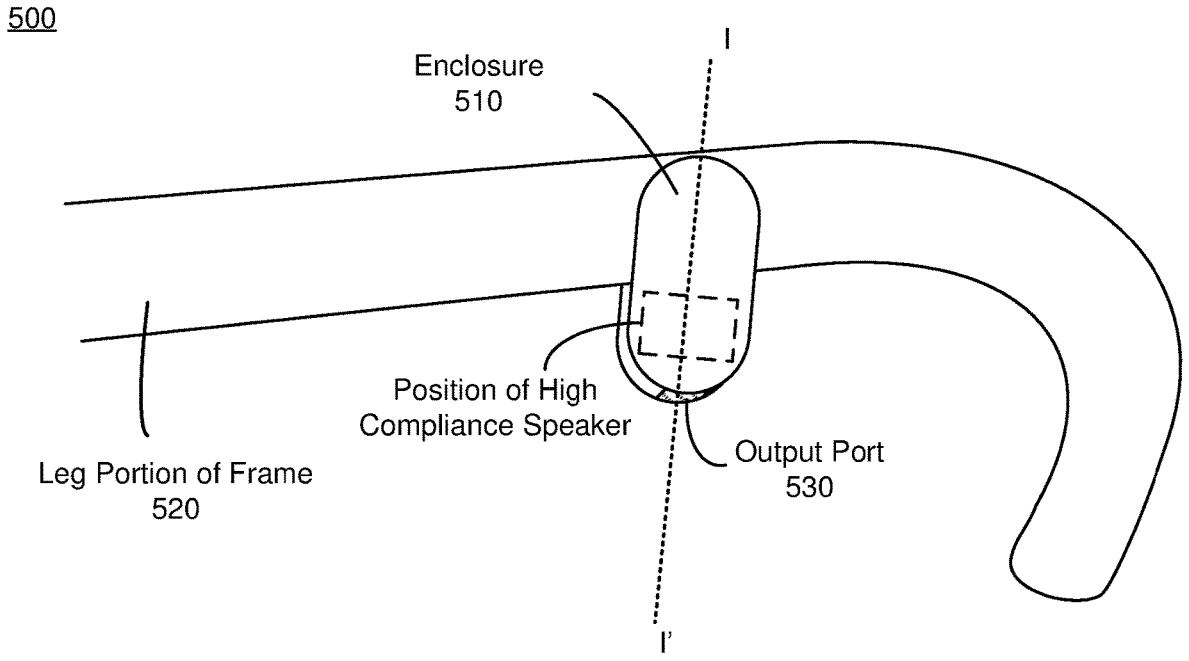
FIG. 5A shows a front view of an enclosure with an offset configuration containing a high compliance speaker, coupled to a leg portion of a frame of a headset, in accordance with one or more embodiments.

FIG. 5A shows a front view 500 of the enclosure 510 with an offset configuration containing a high compliance speaker, coupled to a leg portion of a frame 520 of a headset, in accordance with one or more embodiments. The enclosure 510 is an embodiment of the enclosure 140 that has an offset configuration. The enclosure 510 with the offset configuration has an elongated elliptical shape which extends from the leg portion of the frame 520 downwards in a direction corresponding to an ear of a user. The elongated elliptical shape may correspond to an elliptical prism. In other embodiments, the enclosure 510 has another shape. For example, the enclosure 510 may have a rectangular shape that extends downwards in the direction corresponding to the ear of the user.

In some embodiments, a portion of the enclosure 510 may be a distinct component from the rest of the enclosure 510 that can be separated from the rest of the enclosure 510 and reattached. In other embodiments, the enclosure 510 forms one continuous body. The enclosure 510 may be coupled as an attachment to the leg portion of the frame 520. Alternatively, at least a portion of the enclosure 510 may be integrated as part of the frame of the headset.

Figure 5B:
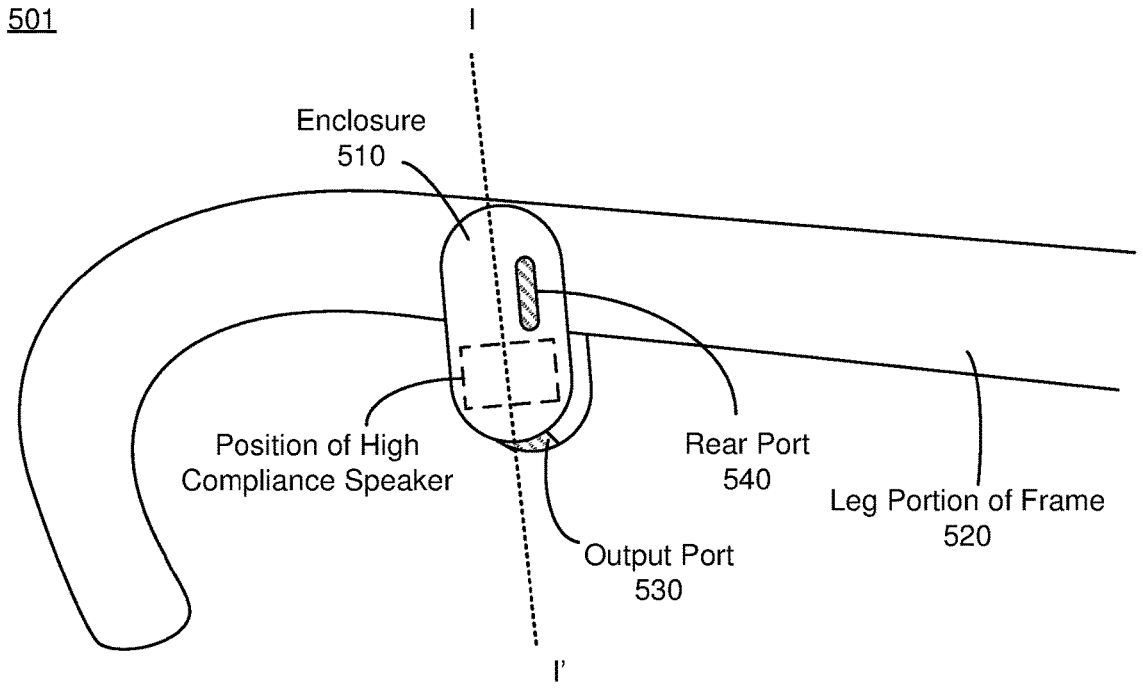
FIG. 5B shows a rear view of the enclosure with the offset configuration shown in FIG. 5A, in accordance with one or more embodiments.
Figure 5C:
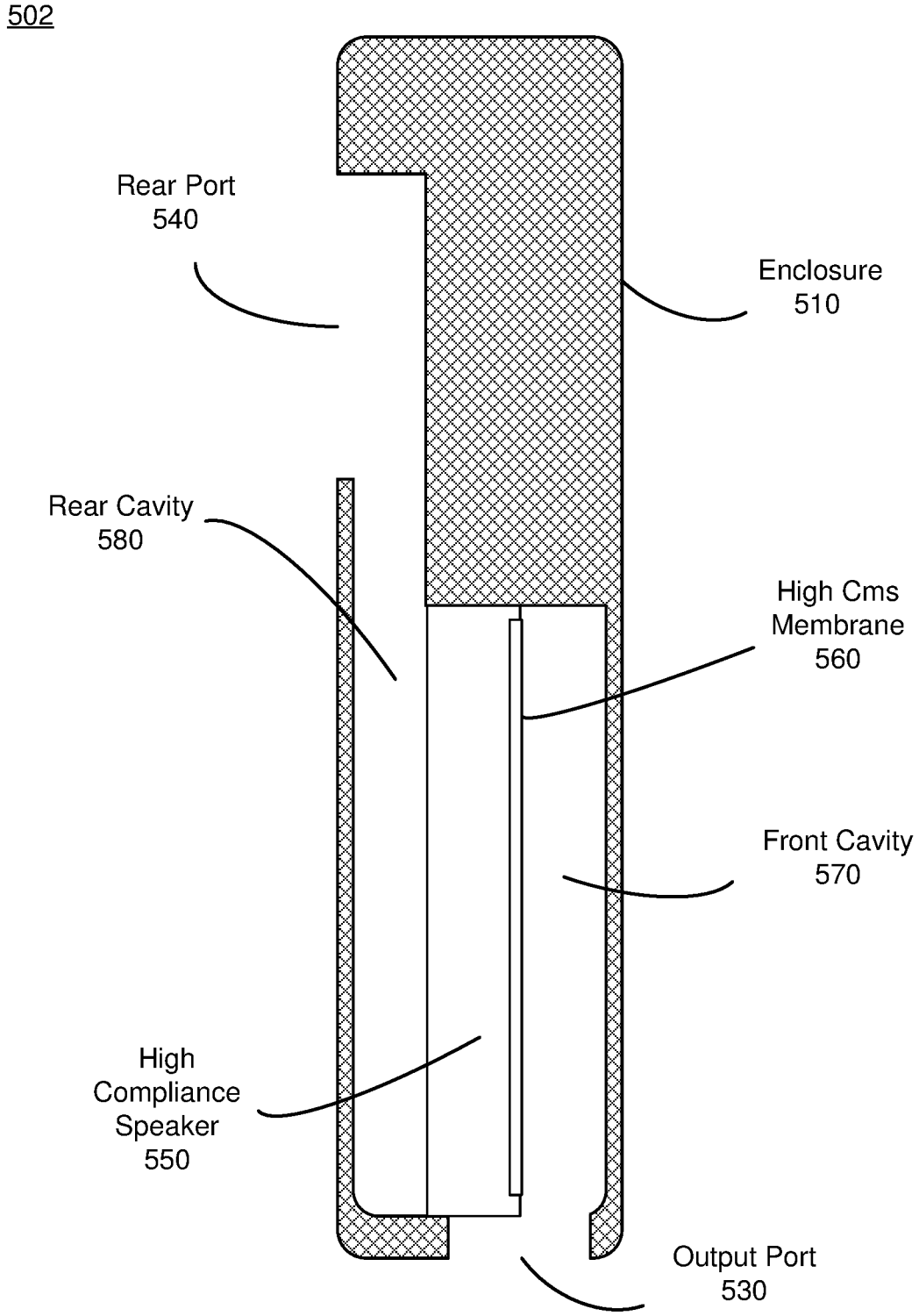
FIG. 5C shows a cross-section along a line I to I' of the enclosure 510 shown in FIGS. 5A and 5B, in accordance with one or more embodiments.

The offset configuration may result in an output port 530 of the enclosure 510 being closer to an ear of the user than the output port 330 of the enclosure 310 shown in FIG. 3, according to some embodiments. According to some embodiments, the enclosure 510 includes a plurality of output ports 530. In some embodiments, the high compliance speaker is positioned in a lower portion of the enclosure 510, as shown in FIGS. 5A-5C. The audio system including the enclosure 510 may achieve higher perceived volumes than the enclosure 310, by positioning the output port 530 proximate (e.g., within 5 mm) to an ear of the user, while also achieving the same improved audio performance and acoustic dipole emissions as the audio system with the enclosure 310, according to some embodiments.

FIG. 5B shows a rear view 501 of the enclosure 510 with the offset configuration shown in FIG. 5A, in accordance with one or more embodiments. The rear view 501 shows the leg portion of the frame 520 and the enclosure 510 from a perspective opposite to the one shown in the front view 500 of FIG. 5A. The enclosure 510 includes a rear port 540 coupled to a rear cavity of the enclosure. The enclosure 510 may include a plurality of rear ports 540, in some embodiments. As with the enclosure 410, the combination of the output port 530 and the rear port 540 and the rear port 540 enable the emitted sound from the audio system to have a dipole configuration.

FIG. 5C shows a cross-section 502 along a line I to I' of the enclosure 510 shown in FIGS. 5A and 5B, in accordance with one or more embodiments. The high compliance speaker 550 is an embodiment of the high compliance speaker 550 and includes a high Cms membrane 560 facing a front cavity 570. The enclosure 510 forms the front cavity 570 coupled to the output port 530 and a rear cavity 580 coupled to the rear port 540. The high compliance speaker 550 is positioned in a lower portion of the enclosure 510 between the front cavity 570 and the rear cavity 580. In some embodiments, the high compliance speaker 550 separates the front cavity 570 and the rear cavity 580, as shown in FIG. 5C. The high Cms membrane 560 shown in FIG. 5C does not directly face the output port 530, but in other embodiments, the high Cms membrane 560 may directly face the output port 530.

In some embodiments, the high compliance speaker 550 has a rectangular shape, as with the high compliance speaker 210 shown in FIG. 2A. In other embodiments, the high compliance speaker 550 has an elliptical shape. In further embodiments, the high compliance speaker 550 has an elliptical shape corresponding to the shape of the enclosure 510.

In some embodiments, the enclosure 510 may have a different configuration than is shown in FIGS. 5A-5C, including a different number and position of output ports 530 and rear ports 540. While FIGS. 5A-5C show the enclosure 510 with one output port 530 and one rear port 540, the enclosure 510 may include one or more output ports 530 and/or one or more rear ports 540, according to some embodiments.

Figure 6A:
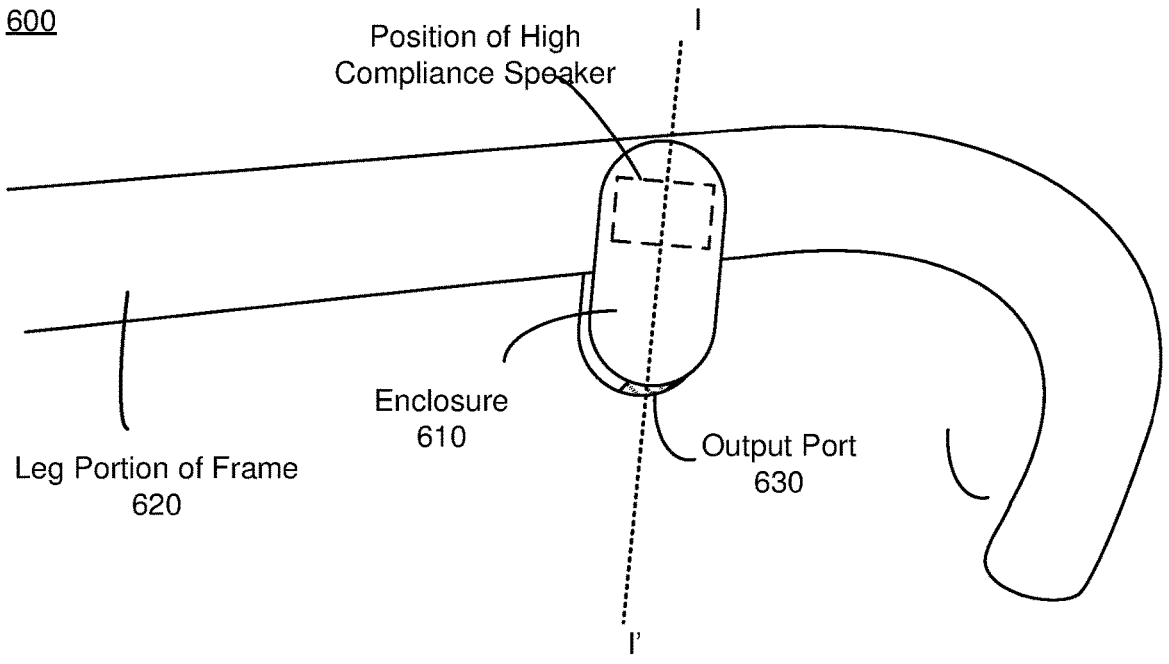
FIG. 6A shows a front view of an enclosure with an offset configuration containing a high compliance speaker, coupled to a leg portion of a frame of a headset, in accordance with one or more embodiments.

FIG. 6A shows a front view 600 of an enclosure 610 with an offset configuration containing a high compliance speaker, coupled to a leg portion of a frame 620 of a headset, in accordance with one or more embodiments. The enclosure 610 is an embodiment of the enclosure 510 that has the offset configuration. The enclosure 610 includes the same components and elongated elliptical shape as the enclosure 510, but with the high compliance speaker positioned in an upper portion of the high compliance speaker. Like the enclosure 510 shown in FIGS. 5A-5C, the enclosure 610 includes an output port 630 coupled to a front cavity of the enclosure 610. In some embodiments, the enclosure 610 includes a plurality of output ports 630.

Figure 6B:
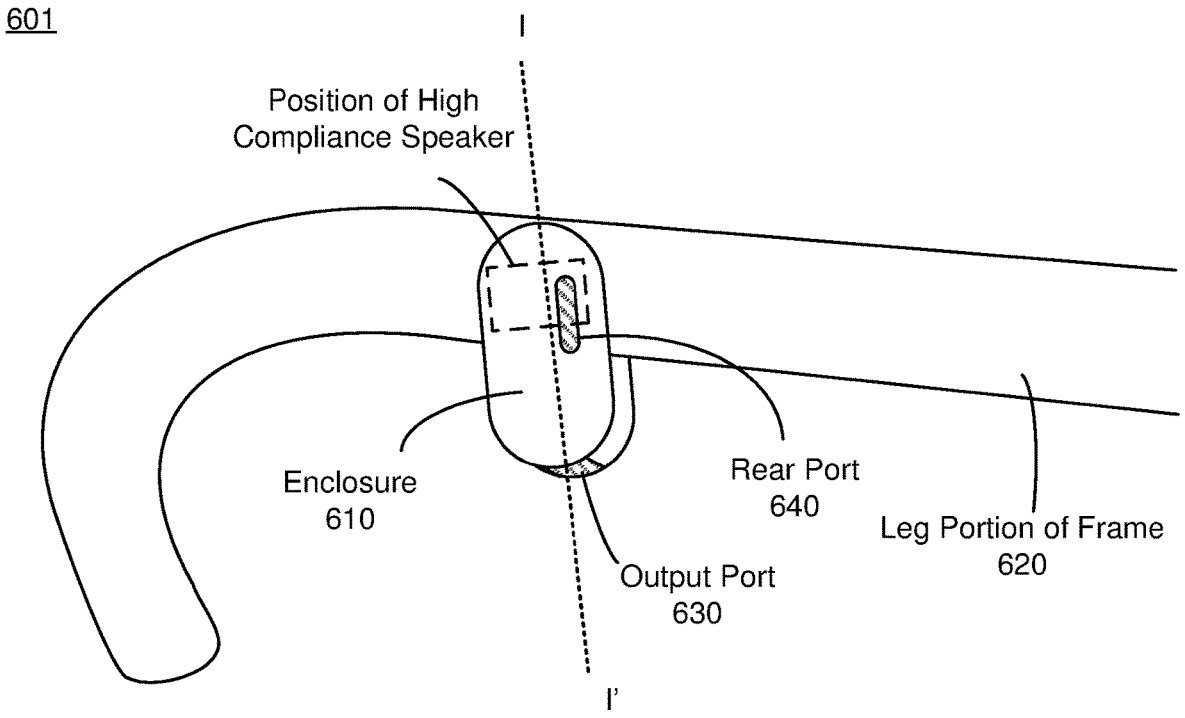
FIG. 6B shows a rear view of the enclosure shown in FIG. 6A, in accordance with one or more embodiments.

FIG. 6B shows a rear view 601 of the enclosure 610 shown in FIG. 6A, in accordance with one or more embodiments. The rear view 601 shows the leg portion of the frame 620 and the enclosure 610 from a perspective opposite to the one shown in the rear view 600 of FIG. 6A. Like the enclosure 510 shown in FIGS. 5A-5C, the enclosure 610 includes a rear port 640 coupled to a rear cavity of the enclosure 610. As such, the enclosure 610 shares the same advantages as the enclosure 510, including the high audio performance and dipole configuration of emitted sounds, in some embodiments. In some embodiments, the enclosure 610 includes a plurality of rear ports 640.

Figure 6C:
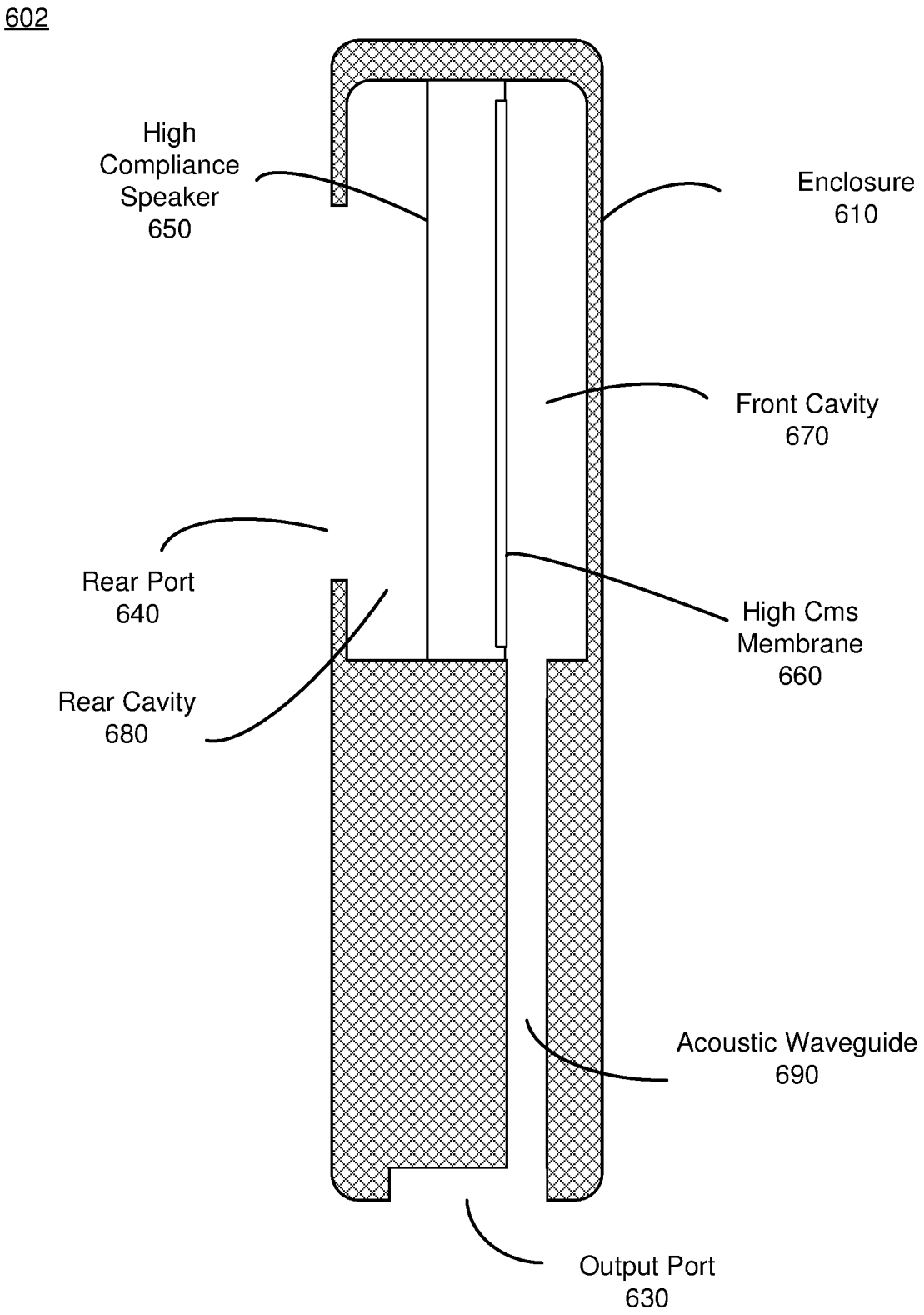
FIG. 6C shows a cross-section along a line I to I' of the enclosure 610 shown in FIGS. 6A and 6B, in accordance with one or more embodiments.

FIG. 6C shows a cross-section along a line I to I' of the enclosure 610 shown in FIGS. 6A and 6B, in accordance with one or more embodiments. The enclosure 610 contains a high compliance speaker 650 with a high Cms membrane 660 facing a front cavity 670. The enclosure 610 forms the front cavity 670 coupled to the output port 630 and a rear cavity 680 coupled to the rear port 640. The high compliance speaker 650 is positioned in an upper portion of the enclosure 610.

In some embodiments, the output port 630 is positioned spatially apart from the front cavity 670. As shown in FIG. 6C, the output port 630 may be positioned in a lower portion of the enclosure 610, while the high compliance speaker 650 and the front cavity 670 are positioned in an upper portion of the enclosure 610. In this case, the enclosure 610 may also form an acoustic waveguide 690 that connects the front cavity 670 to the output port 630. The acoustic waveguide 690 couples the front cavity 670 and the output port 630, providing a pathway for the first portion of the sound emitted from the high compliance speaker 650 to travel from the front cavity 670 to the output port 630, where the first portion of sound is outputted. The acoustic waveguide 690 guides the sound to a position of the output port 630, closer to a user's ear, for example, than the position of the high compliance speaker 650. In other embodiments, the acoustic waveguide 690 guides the sound to a different output location. The high Cms membrane 660, as shown in FIG. 6C, does not directly face the acoustic waveguide 690, but in some embodiments, the high Cms membrane 660 may directly face a portion of the acoustic waveguide 690.

In some embodiments, the enclosure 610 may include different components and configurations than is shown in FIGS. 6A-6C. For example, the output port 630 may also be positioned in the upper portion of the enclosure 610, with the acoustic waveguide 690 omitted from the enclosure 610. While FIGS. 6A-6C show the enclosure 610 with one output port 630 and one rear port 640, the enclosure 610 may include a plurality of output ports 630 and/or a plurality of rear ports 640, according to some embodiments. Similarly, the enclosure 610 may have a different number of acoustic waveguides 690 and/or a different shape and size of the acoustic waveguide 690. Additionally, the enclosure 610 may include an acoustic waveguide that connects the rear cavity 680 to a rear port, similarly to the acoustic waveguide 690.

An enclosure 610 with the offset configuration may have improved power efficiency over the enclosure 310, shown in FIGS. 3A-3C and 4, since the offset configuration allows the output port 630 of the enclosure to be located closer to an ear of a user wearing the headset, thus reducing the power necessary to drive the audio system. The enclosure with the offset configuration may additionally have the audio performance benefits of the enclosure 310, such as the low far-field leakage of sound due to the dipole configuration of the sound emitted from the enclosure and the high Vas of the audio system.

Embodiments of the audio system have the advantage of a small form factor, while maintaining improved audio performance. The combination of the high compliance speaker and the enclosure provide the advantage of a large Vas for an audio system that has a relatively small form factor and cavity volume. In some embodiments, the audio system has a Vas greater than 30 cc. In some embodiments, the air volume displacement of the high compliance speaker is greater than 60 cubic millimeters. The audio system may have superior performance compared to conventional rectangular speakers used in devices such as smartphones or tablet computers, in terms of sound volume, power efficiency, bandwidth, and unwanted vibrations of devices integrated with the audio system.

Figure 7:
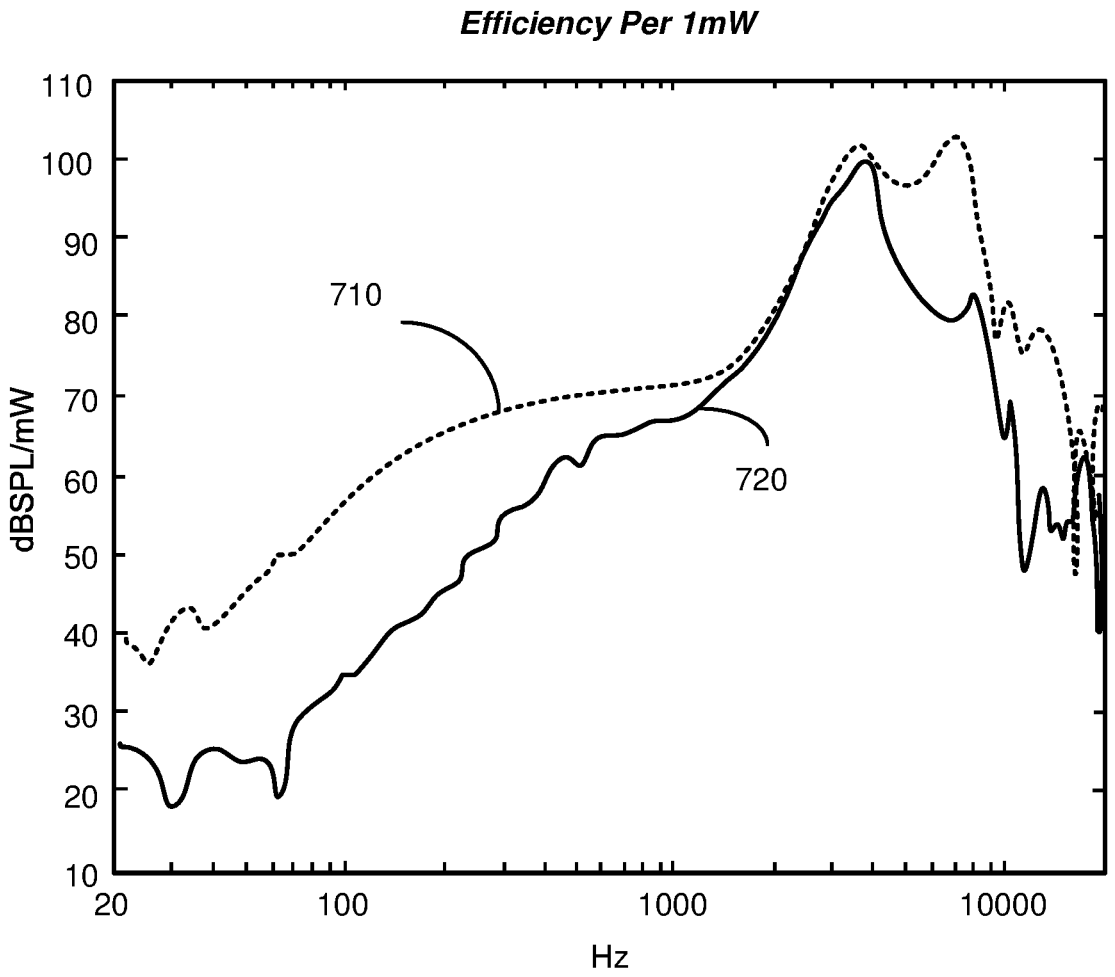
FIG. 7 illustrates power efficiency for various sound frequencies for examples of audio systems, in accordance with one or more embodiments.

Due in part to the low resonant frequencies of the high compliance speaker, the audio system may have superior power efficiency at low frequencies, with less unwanted vibration of the audio system and any devices or structures coupled to the audio system, in comparison to similarly sized speaker systems using low compliance speakers. FIG. 7 illustrates power efficiency for various sound frequencies for examples of audio systems, in accordance with one or more embodiments. Curve 710 shows the power efficiency for various sound frequencies for an audio system with the high compliance speaker combined with an embodiment of the enclosure 140. Curve 720 shows the power efficiency for various sound frequencies for a similarly sized audio system with a low compliance speaker. As is seen in FIG. 7, the audio system with the high compliance speaker is significantly higher for low frequencies, particularly at frequencies lower than 1 kHz.

Additionally, the audio system emits sounds with dipole acoustic cancellation due to the dipole configuration of the emitted sounds, resulting in relatively low leakage of sound into the far-field, according to some embodiments. In some embodiments, the audio system has less leakage of sound into the far-field than examples of audio systems with low compliance speakers. In particular, for certain frequencies (e.g. above 3 kHz), examples of the audio system exhibit less leakage of sound into the far-field than an example of an audio system with low compliance speakers Another advantage of the audio system is the form factor and weight. Conventional audio systems that can achieve the same Vas may have a greater weight and size than the audio system including the high compliance speaker and the enclosure, according to some embodiments. For example, an embodiment of the enclosure may have dimensions of 12 mm×20 mm×8 mm, and the weight of two high compliance speakers used in the audio system may be less than 4 grams. In this example, the audio system may have a Vas greater than 20 cc. A conventional audio system that achieves a similar Vas would have a physical volume greater than 20 cc.

Example System Environment

Figure 8:
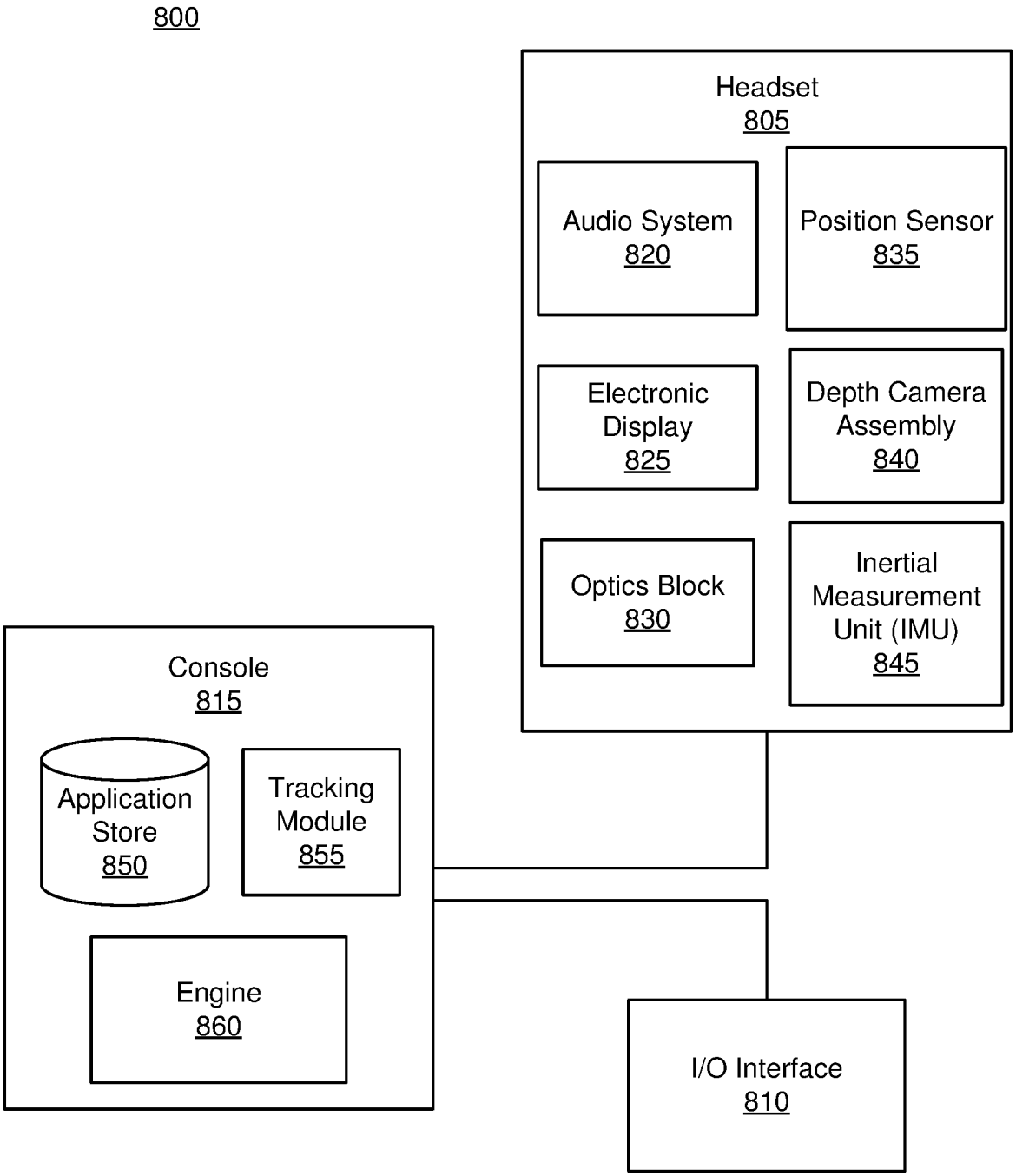
FIG. 8 is an example system environment of a headset including an audio system, in accordance with one or more embodiments.

FIG. 8 is an example system environment of a headset including an audio system, in accordance with one or more embodiments. The system 800 may operate in an artificial reality environment. The system 800 shown in FIG. 8 includes a headset 805 and an input/output (I/O) interface 810 that is coupled to a console 815. The headset 805 may be an embodiment of the headset 100. While FIG. 8 shows an example system 800 including one headset 805 and one I/O interface 810, in other embodiments any number of these components may be included in the system 800. For example, there may be multiple headsets 805 each having an associated I/O interface 810 with each headset 805 and I/O interface 810 communicating with the console 815. In alternative configurations, different and/or additional components may be included in the system 800. Additionally, functionality described in conjunction with one or more of the components shown in FIG. 8 may be distributed among the components in a different manner than described in conjunction with FIG. 8 in some embodiments. For example, some or all of the functionality of the console 815 is provided by the headset 805.

In some embodiments, the headset 805 may correct or enhance the vision of a user, protect the eye of a user, or provide images to a user. The headset 805 may be eyeglasses which correct for defects in a user's eyesight. The headset 805 may be sunglasses which protect a user's eye from the sun. The headset 805 may be safety glasses which protect a user's eye from impact. The headset 805 may be a night vision device or infrared goggles to enhance a user's vision at night. Alternatively, the headset 805 may not include lenses and may be just a frame with an audio system 820 that provides audio (e.g., music, radio, podcasts) to a user.

In some embodiments, the headset 805 may be a head-mounted display that presents content to a user comprising augmented views of a physical, real-world environment with computer-generated elements (e.g., two dimensional (2D) or three dimensional (3D) images, 2D or 3D video, sound, etc.). In some embodiments, the presented content includes audio that is presented via an audio system 820 that receives audio information from the headset 805, the console 815, or both, and presents audio data based on the audio information. In some embodiments, the headset 805 presents virtual content to the user that is based in part on a real environment surrounding the user. For example, virtual content may be presented to a user of the eyewear device. The user physically may be in a room, and virtual walls and a virtual floor of the room are rendered as part of the virtual content. In the embodiment of FIG. 8, the headset 805 includes an audio system 820, an electronic display 825, an optics block 830, a position sensor 835, a depth camera assembly (DCA) 840, and an inertial measurement (IMU) unit 845. Some embodiments of the headset 805 have different components than those described in conjunction with FIG. 8. Additionally, the functionality provided by various components described in conjunction with FIG. 8 may be distributed differently among the components of the headset 805 in other embodiments or be captured in separate assemblies remote from the headset 805.

The audio system 820 includes one or more audio assemblies and an audio controller. For example, the audio system may include one or more audio assemblies coupled to a left side of a frame of the headset 805 and one or more audio assemblies coupled to a right side of the frame of the headset 805. Each audio assembly includes one or more high compliance speaker configured to emit sounds. Each audio assembly may also include at least some of an enclosure containing one of the one or more high compliance speakers. In some embodiments, the enclosure contains a plurality of high compliance speakers. In some embodiments, the remaining portion of the enclosure is part of the frame of the headset 805. In other embodiments the audio assembly include all of the enclosure, and the whole enclosure couples to the frame of the headset 805.

The audio assembly may be an embodiment of the audio assembly including the high compliance speakers 135 and some of each of the enclosures 140. As described above with regard to FIG. 1, the enclosure of the audio assembly may include at least one output port coupled to a front cavity formed by the enclosure and at least one rear port coupled to a rear cavity formed by the enclosure, with the speaker separating the front cavity from the rear cavity. The output port is configured to emit a first portion of the sound emitted by the high compliance speaker, and the rear port is configured to emit a second portion of the sound emitted by the high compliance speaker, with the first portion of the sound being substantially out of phase with the second portion of the sound. The audio system achieves a Vas greater than ten times a volume of the front cavity and greater than ten times a volume of the rear cavity. The audio system 820 includes an audio controller that may generate instructions for the speaker assembly to emit audio content. Note that in some embodiments, some or all of the audio controller is part of the console 815.

The electronic display 825 displays 2D or 3D images to the user in accordance with data received from the console 815. In various embodiments, the electronic display 825 comprises a single electronic display or multiple electronic displays (e.g., a display for each eye of a user). Examples of the electronic display 825 include: a liquid crystal display (LCD), an organic light emitting diode (OLED) display, an active-matrix organic light-emitting diode display (AMOLED), some other display, or some combination thereof.

The optics block 830 magnifies image light received from the electronic display 825, corrects optical errors associated with the image light, and presents the corrected image light to a user of the headset 805. The electronic display 825 and the optics block 830 may be an embodiment of the display element 110. In various embodiments, the optics block 830 includes one or more optical elements. Example optical elements included in the optics block 830 include: an aperture, a Fresnel lens, a convex lens, a concave lens, a filter, a reflecting surface, or any other suitable optical element that affects image light. Moreover, the optics block 830 may include combinations of different optical elements. In some embodiments, one or more of the optical elements in the optics block 830 may have one or more coatings, such as partially reflective or anti-reflective coatings.

Magnification and focusing of the image light by the optics block 830 allows the electronic display 825 to be physically smaller, weigh less, and consume less power than larger displays. Additionally, magnification may increase the field of view of the content presented by the electronic display 825. For example, the field of view of the displayed content is such that the displayed content is presented using almost all (e.g., approximately 110 degrees diagonal), and in some cases, all of the user's field of view. Additionally, in some embodiments, the amount of magnification may be adjusted by adding or removing optical elements.

In some embodiments, the optics block 830 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display 825 for display is pre-distorted, and the optics block 630 corrects the distortion when it receives image light from the electronic display 825 generated based on the content.

The DCA 840 captures data describing depth information for a local area surrounding the headset 805. In one embodiment, the DCA 840 may include a structured light projector, an imaging device, and a controller. The imaging device may be an embodiment of the imaging device 120. The structured light projector may be an embodiment of the illuminator 125. The captured data may be images captured by the imaging device of structured light projected onto the local area by the structured light projector. In one embodiment, the DCA 840 may include two or more cameras that are oriented to capture portions of the local area in stereo and a controller. The captured data may be images captured by the two or more cameras of the local area in stereo. The controller computes the depth information of the local area using the captured data. Based on the depth information, the controller determines absolute positional information of the headset 805 within the local area. The DCA 840 may be integrated with the headset 805 or may be positioned within the local area external to the headset 805.

The IMU 845 is an electronic device that generates data indicating a position of the headset 805 based on measurement signals received from one or more position sensors 835. The one or more position sensors 835 may be an embodiment of the position sensor 115. A position sensor 835 generates one or more measurement signals in response to motion of the headset 805. Examples of position sensors 835 include: one or more accelerometers, one or more gyroscopes, one or more magnetometers, another suitable type of sensor that detects motion, a type of sensor used for error correction of the IMU 845, or some combination thereof. The position sensors 835 may be located external to the IMU 845, internal to the IMU 845, or some combination thereof.

Based on the one or more measurement signals from one or more position sensors 835, the IMU 845 generates data indicating an estimated current position of the headset 805 relative to an initial position of the headset 805. For example, the position sensors 835 include multiple accelerometers to measure translational motion (forward/back, up/down, left/right) and multiple gyroscopes to measure rotational motion (e.g., pitch, yaw, and roll). In some embodiments, the IMU 845 rapidly samples the measurement signals and calculates the estimated current position of the headset 805 from the sampled data. For example, the IMU 845 integrates the measurement signals received from the accelerometers over time to estimate a velocity vector and integrates the velocity vector over time to determine an estimated current position of a reference point on the headset 805. Alternatively, the IMU 845 provides the sampled measurement signals to the console 815, which interprets the data to reduce error. The reference point is a point that may be used to describe the position of the headset 805. The reference point may generally be defined as a point in space or a position related to the eyewear device's 805 orientation and position.

The IMU 845 receives one or more parameters from the console 815. As further discussed below, the one or more parameters are used to maintain tracking of the headset 805. Based on a received parameter, the IMU 845 may adjust one or more IMU parameters (e.g., sample rate). In some embodiments, data from the DCA 840 causes the IMU 845 to update an initial position of the reference point so it corresponds to a next position of the reference point. Updating the initial position of the reference point as the next calibrated position of the reference point helps reduce accumulated error associated with the current position estimated the IMU 845. The accumulated error, also referred to as drift error, causes the estimated position of the reference point to "drift" away from the actual position of the reference point over time. In some embodiments of the headset 805, the IMU 845 may be a dedicated hardware component. In other embodiments, the IMU 845 may be a software component implemented in one or more processors.

The I/O interface 810 is a device that allows a user to send action requests and receive responses from the console 815. An action request is a request to perform a particular action. For example, an action request may be an instruction to start or end capture of image or video data, start or end the audio system 820 from producing sounds, start or end a calibration process of the headset 805, or an instruction to perform a particular action within an application. The I/O interface 810 may include one or more input devices. Example input devices include: a keyboard, a mouse, a game controller, or any other suitable device for receiving action requests and communicating the action requests to the console 815. An action request received by the I/O interface 810 is communicated to the console 815, which performs an action corresponding to the action request. In some embodiments, the I/O interface 815 includes an IMU 845, as further described above, that captures calibration data indicating an estimated position of the I/O interface 810 relative to an initial position of the I/O interface 810. In some embodiments, the I/O interface 810 may provide haptic feedback to the user in accordance with instructions received from the console 815. For example, haptic feedback is provided when an action request is received, or the console 815 communicates instructions to the I/O interface 810 causing the I/O interface 810 to generate haptic feedback when the console 815 performs an action.

The console 815 provides content to the headset 805 for processing in accordance with information received from one or more of: the headset 805 and the I/O interface 810. In the example shown in FIG. 8, the console 815 includes an application store 850, a tracking module 855, and an engine 860. Some embodiments of the console 815 have different modules or components than those described in conjunction with FIG. 8. Similarly, the functions further described below may be distributed among components of the console 815 in a different manner than described in conjunction with FIG. 8.

The application store 850 stores one or more applications for execution by the console 815. An application is a group of instructions, that when executed by a processor, generates content for presentation to the user. Content generated by an application may be in response to inputs received from the user via movement of the headset 805 or the I/O interface 810. Examples of applications include: gaming applications, conferencing applications, video playback applications, calibration processes, or other suitable applications.

The tracking module 855 calibrates the system environment 800 using one or more calibration parameters and may adjust one or more calibration parameters to reduce error in determination of the position of the headset 805 or of the I/O interface 810. Calibration performed by the tracking module 855 also accounts for information received from the IMU 845 in the headset 805 and/or an IMU 845 included in the I/O interface 810. Additionally, if tracking of the headset 805 is lost, the tracking module 855 may re-calibrate some or all of the system environment 800.

The tracking module 855 tracks movements of the headset 805 or of the I/O interface 810 using information from the one or more sensor devices 835, the IMU 845, or some combination thereof. For example, the tracking module 855 determines a position of a reference point of the headset 805 in a mapping of a local area based on information from the headset 805. The tracking module 855 may also determine positions of the reference point of the headset 805 or a reference point of the I/O interface 810 using data indicating a position of the headset 805 from the IMU 845 or using data indicating a position of the I/O interface 810 from an IMU 845 included in the I/O interface 810, respectively. Additionally, in some embodiments, the tracking module 855 may use portions of data indicating a position or the headset 805 from the IMU 845 to predict a future location of the headset 805. The tracking module 855 provides the estimated or predicted future position of the headset 805 or the I/O interface 810 to the engine 860.

The engine 860 also executes applications within the system environment 800 and receives position information, acceleration information, velocity information, predicted future positions, audio information, or some combination thereof of the headset 805 from the tracking module 855. Based on the received information, the engine 860 determines content to provide to the headset 805 for presentation to the user. For example, if the received information indicates that the user has looked to the left, the engine 860 generates content for the headset 605 that mirrors the user's movement in a virtual environment or in an environment augmenting the local area with additional content. Additionally, the engine 860 performs an action within an application executing on the console 815 in response to an action request received from the I/O interface 810 and provides feedback to the user that the action was performed. The provided feedback may be visual or audible feedback via the headset 805 or haptic feedback via the I/O interface 810.

ADDITIONAL CONSIDERATIONS

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the disclosure may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. An audio system comprising:

a speaker configured to emit sound; and at least part of an enclosure containing the speaker, the enclosure forming a front cavity and a rear cavity that are on opposite sides of the speaker, and the enclosure includes:

at least one output port configured to output a first portion of the sound from the front cavity, and at least one rear port configured to output a second portion of the sound from the rear cavity, and the second portion of the sound is substantially out of phase with the first portion of the sound, wherein an equivalent acoustic volume (Vas) of the audio system is greater than ten times a volume of the front cavity and greater than ten times a volume of the rear cavity.

2. The audio system of claim 1, wherein the speaker is a high compliance speaker comprising a membrane with a mechanical compliance (Cms) that is at least 10 millimeters/Newton, the membrane configured to generate the emitted sound.

3. The audio system of claim 1, wherein the at least one rear port is a resistive port configured to dampen the second portion of the sound.

4. The audio system of claim 1, wherein the speaker has a rectangular shape.

5. The audio system of claim 1, wherein the second portion of the sound has a 180° phase offset from the first portion of the sound.

6. The audio system of claim 1, wherein the enclosure comprises two rear ports.

7. The audio system of claim 1, wherein the audio assembly includes the enclosure in its entirety, and the entirety of the enclosure is coupled to a frame of a headset.

8. The audio system of claim 1, wherein the speaker has a force ratio less than 0.1, wherein the force ratio is equal to a force required to displace a membrane of the speaker by 0.3 millimeters divided by a reference force.

9. A headset comprising:

a frame; and an audio system comprising:

a speaker configured to emit sound; and at least a part of an enclosure coupled to the frame and containing the speaker, the enclosure forming a front cavity and a rear cavity that are separated by the speaker, and the enclosure includes:

at least one output port configured to output a first portion of the sound from the front cavity, and at least one rear port configured to output a second portion of the sound from the rear cavity, and the second portion of the sound is substantially out of phase with the first portion, wherein an equivalent acoustic volume (Vas) of the audio system is greater than ten times a volume of the front cavity and greater than ten times a volume of the rear cavity.

10. The headset of claim 9, wherein the speaker is a high compliance speaker comprising a membrane with a mechanical compliance (Cms) that is at least 10 millimeters/Newton, the membrane configured to produce the emitted sound.

11. The headset of claim 10, wherein the high compliance speaker has a rectangular shape.

12. The headset of claim 9, wherein the at least one output port faces an interior of the frame, and the at least one rear port faces an exterior of the frame.

13. The headset of claim 9, wherein the audio system comprises a plurality of enclosures coupled to the frame in a speaker array, each enclosure of the plurality of enclosures containing one or more of the speakers.

14. The headset of claim 9, wherein the enclosure is positioned on a leg portion of the frame, the enclosure has an elongated elliptical shape, the enclosure extends from the leg portion of the frame in a direction corresponding to an ear of a user, and the at least one output port is positioned in a lower portion of the enclosure proximate to the ear of the user, such that the first portion of the sound is directed towards the ear of the user.

15. The headset of claim 14, wherein the speaker is positioned in the lower portion of the enclosure.

16. The headset of claim 14, wherein the speaker and the front cavity are positioned in an upper portion of the enclosure and spaced apart from the output port.

17. The headset of claim 16, further comprising:

an audio waveguide within the enclosure, the audio waveguide connecting the front cavity to the output port, wherein the first portion of the sound travels from the front cavity through the audio waveguide to the output port.

18. The headset of claim 9, wherein the frame forms at least a portion of the enclosure.

19. The headset of claim 9, wherein the second portion of the sound has a 180° phase offset from the first portion of the sound.

20. An audio system comprising:

a speaker configured to emit sound and contained within an enclosure that is part of a headset, the enclosure forming a front cavity and a rear cavity that are on opposite sides of the speaker, and the enclosure includes:

at least one output port configured to output a first portion of the sound from the front cavity, and at least one rear port configured to output a second portion of the sound from the rear cavity, and the second portion of the sound is substantially out of phase with the first portion of the sound, wherein an equivalent acoustic volume (Vas) of the audio system is greater than ten times a volume of the front cavity and greater than ten times a volume of the rear cavity.

* * * * *